US012319389B2

(12) United States Patent
Reh Aguirre De Carcer

(10) Patent No.: US 12,319,389 B2
(45) Date of Patent: Jun. 3, 2025

(54) HYDROFOIL

(71) Applicant: Pacific Tradewinds, LLC, Wheat Ridge, CO (US)

(72) Inventor: Jaime B. Reh Aguirre De Carcer, Honolulu, HI (US)

(73) Assignee: Pacific Tradewinds, LLC, Wheat Ridge, CO (US)

( * ) Notice: Subject to any disclaimer, the term of this patent is extended or adjusted under 35 U.S.C. 154(b) by 524 days.

(21) Appl. No.: 17/651,228

(22) Filed: Feb. 15, 2022

(65) Prior Publication Data

US 2022/0258837 A1 Aug. 18, 2022

Related U.S. Application Data

(60) Provisional application No. 63/200,135, filed on Feb. 16, 2021.

(51) Int. Cl.
*B63B 32/66* (2020.01)
*B63B 1/26* (2006.01)

(52) U.S. Cl.
CPC ..... *B63B 32/66* (2020.02); *B63B 1/26* (2013.01)

(58) Field of Classification Search
CPC ..... B63B 32/66; B63B 1/242; B63B 32/51; F16B 7/20; F16B 7/22
See application file for complete search history.

(56) References Cited

U.S. PATENT DOCUMENTS 9,669,902 B2 * 6/2017 Geislinger ..... B63B 1/242
2016/0186792 A1 * 6/2016 Valencia ..... F16B 7/0406 403/349

* cited by examiner

*Primary Examiner* — Anthony D Wiest
(74) *Attorney, Agent, or Firm* — Knobbe, Martens Olson & Bear, LLP

(57) ABSTRACT

The disclosure includes systems, assemblies, sub-assemblies and methods for securely attaching components of a hydrofoil for use in water sports. The hydrofoil may include a mast assembly and one or more wings. At least some components of the hydrofoil may be assembled using toolless connections. The toolless connections may prevent relative axial and/or radial movement between components of the hydrofoil.

18 Claims, 28 Drawing Sheets

HYDROFOIL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims priority to U.S. Provisional Application No. 63/200,135, filed Feb. 16, 2021, titled "HYDROFOIL," which is hereby incorporated by reference in its entirety herein.

BACKGROUND

Field

The present invention relates generally to hydrofoils, and more specifically, to a hydrofoil assembly system for ease in mechanically mating hydrofoil components.

Hydrofoils

Hydrofoils generally are surfaces that interact with water as those surfaces are propelled forward. Hydrofoils include a wing or multiple wings mounted on a strut or multiple struts that position the wing or wings in the water. In some designs, the wing or wings interact with the water at speed to create lift, often reducing some or all of a hull or board surface from the water; thereby decreasing water drag resistance. This decrease leads to some or all of better efficiency, additional speed, and/or smoother rides. Designers attach hydrofoil(s) or foil(s) to boats, personal watercraft, surfboards, kiteboards, windsurfing boards, and the like.

For example, FIG. 1 is a picture of a surfer harnessing the energy of an underwater swell using a hydrofoil attached to a surfboard. As shown in FIG. 1, when the surfer reaches a certain speed, the hydrofoil creates lift, raising, in the example of FIG. 1, the surfboard entirely out of the water. As further shown in FIG. 1, the hydrofoil includes one or more wings operating beneath the surface (not shown) positioned by a single strut mounted to the base of the surfboard.

SUMMARY

One challenge of hydrofoil systems is the difficulty in changing the various components after assembly of the hydrofoil, particularly the complexity, time, and needed tools for changing from one hydrofoil component to another, for example different sized wings. Hydrofoil components may be attached together by removable bolts or other fasteners. These hydrofoils often require tools, such as a screwdriver, and often a specialty screwdriver like a torx or hex head screwdriver, to attach and remove components of the hydrofoil. Tool-based attachment mechanisms can be inconvenient and tedious and add weight to the hydrofoil. Additionally, screws can become corroded over time. Accordingly, although strides have been made in the area of hydrofoils, many shortcomings remain.

The systems and methods of use described in the present application overcome one or more of the above-discussed problems commonly associated with conventional hydrofoils, improve the aesthetics, and/or provide straightforward and/or convenient operation and use. These and other unique features of the systems and methods of use are discussed below and illustrated in the accompanying drawings.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Figure 1:
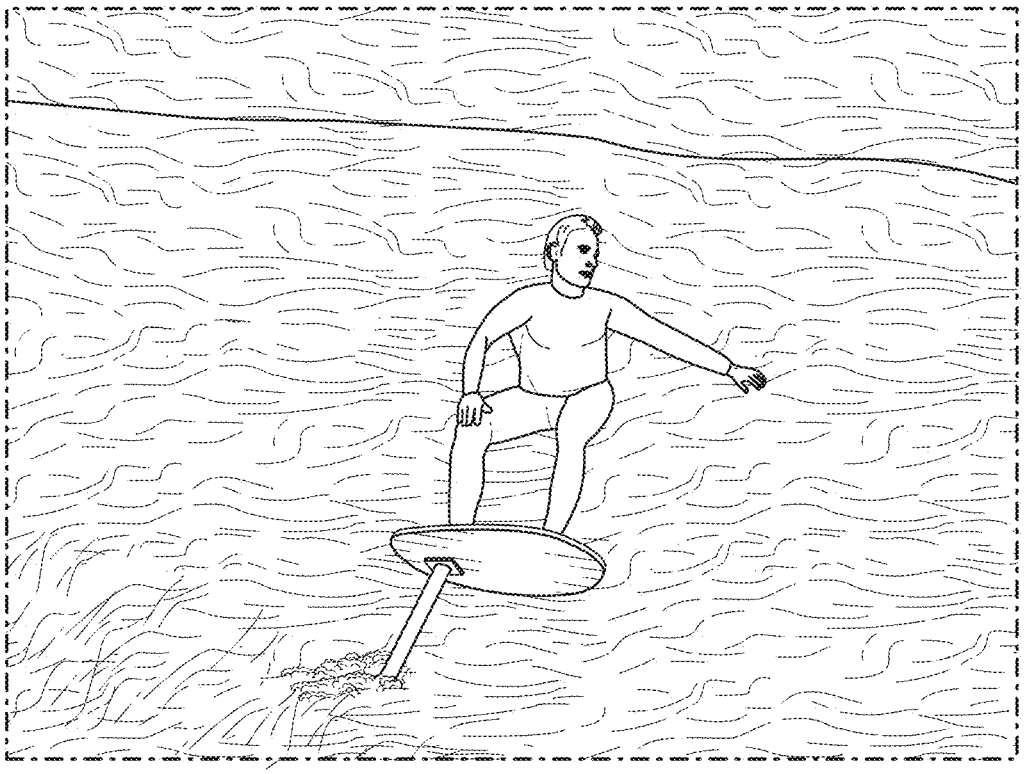
FIG. 1 (Prior Art)
FIG. 1 is a picture of a surfer riding a surfboard with a hydrofoil.
Figure 2A:
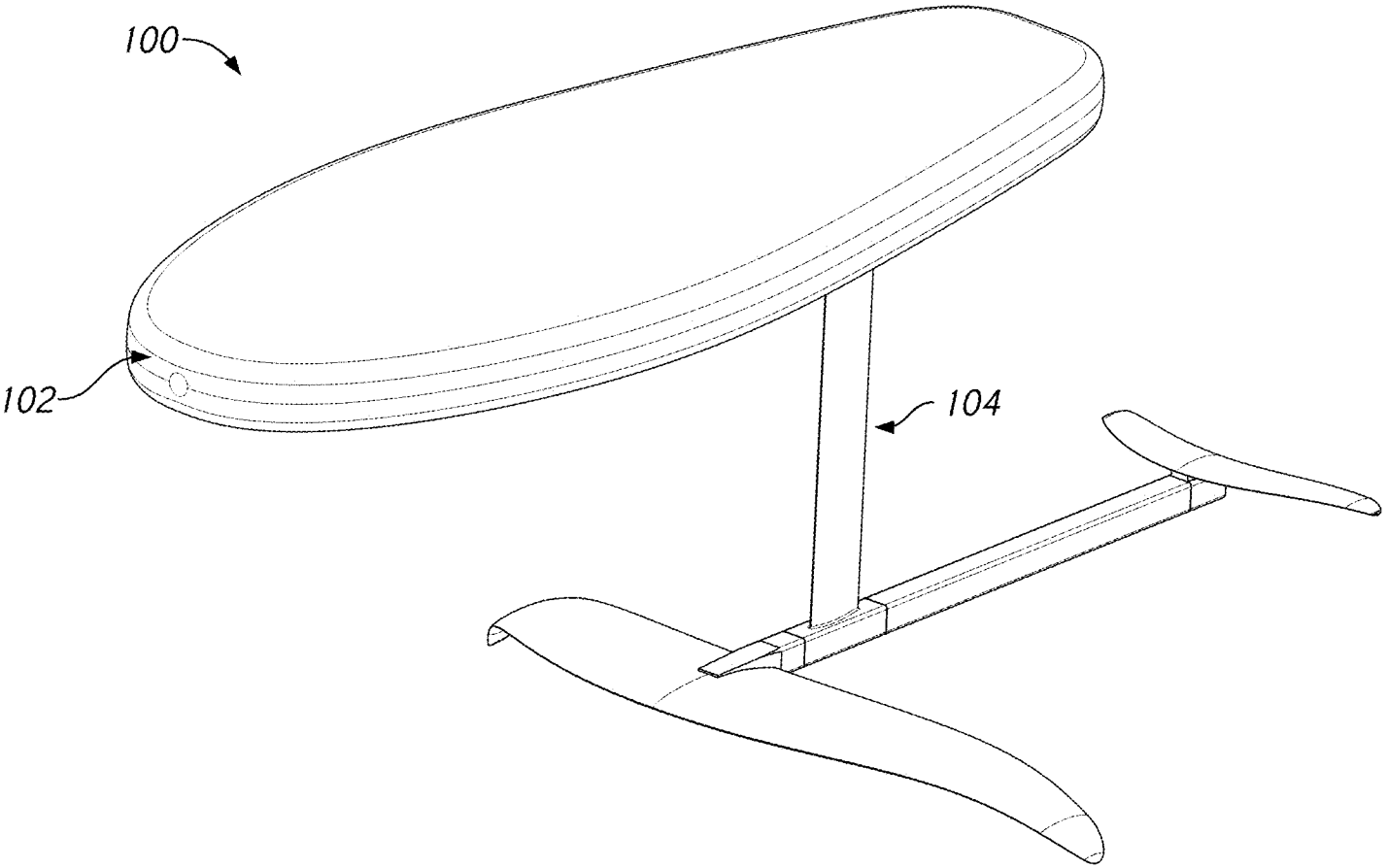
FIGS. 2A-2E illustrate an exemplary hydrofoil system.
Figure 2B:
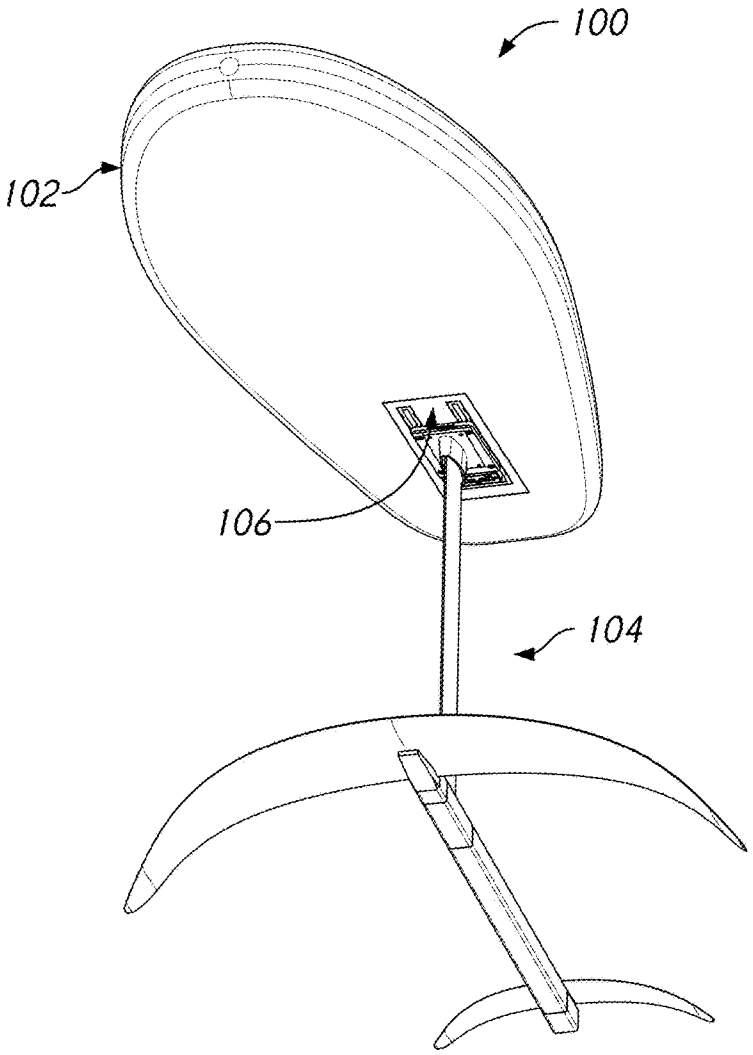
Figure 2C:
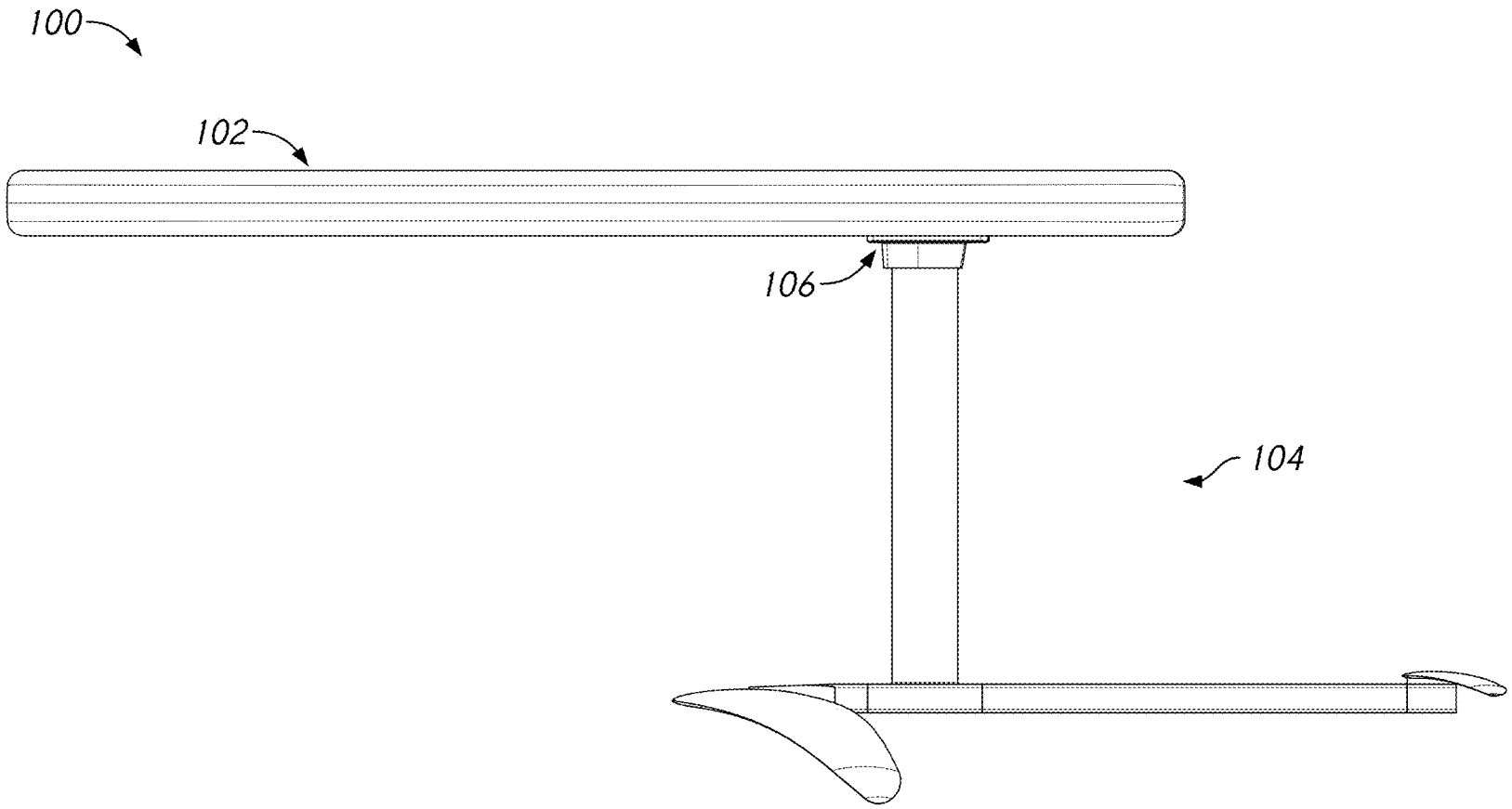
Figure 2D:
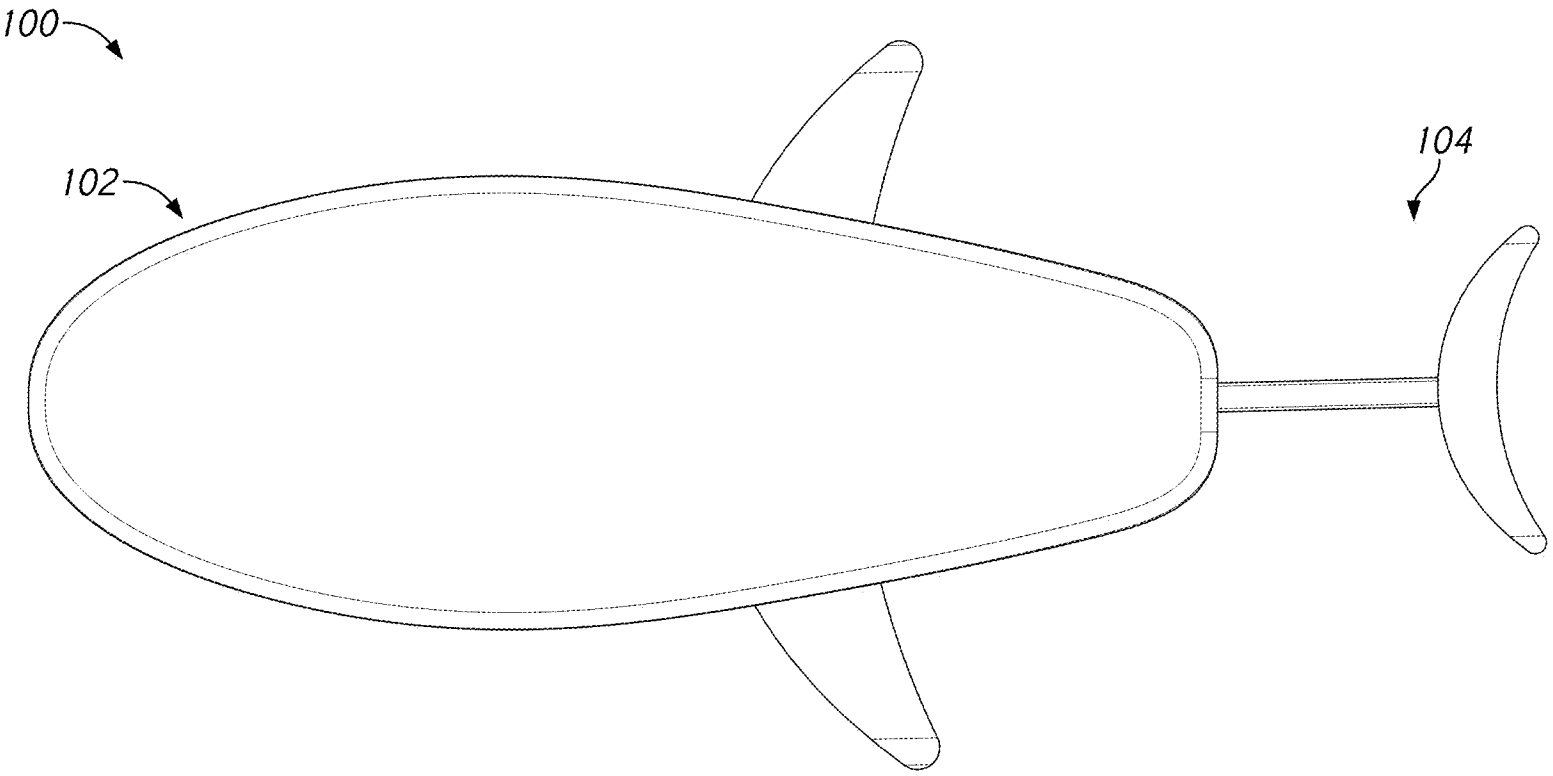
Figure 2E:
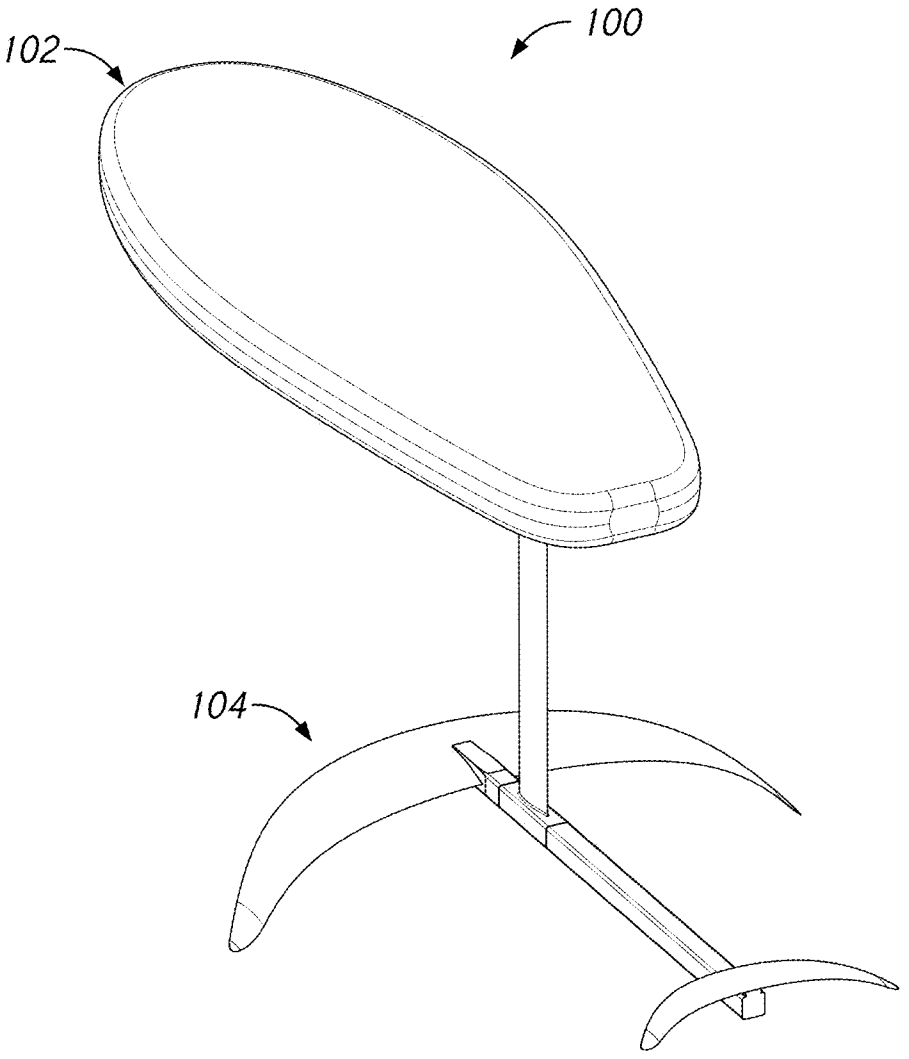

FIGS. 2A-2E illustrate a hydrofoil system 100 including a surfboard 102 attached to a hydrofoil 104. As shown in FIG. 2B, the hydrofoil 104 may be attached to the surfboard 102 using a foil attachment assembly 106. The foil attachment assembly 106 may include any feature of the foil attachment assemblies described in U.S. Publication No.

2021/0047008, filed Aug. 13, 2020, titled "HYDROFOIL ATTACHMENT SYSTEM AND METHOD," and U.S. application Ser. No. 17/651,234, filed the same day as the present application, titled "HYDROFOIL ATTACHMENT SYSTEM AND METHOD," each of which is incorporated by reference in its entirety herein. Although the hydrofoil system is described with respect to a surfboard, the hydrofoil system can be attached to any board configured for water sports, for example kiteboards or windsurfing boards.

Figure 3A:
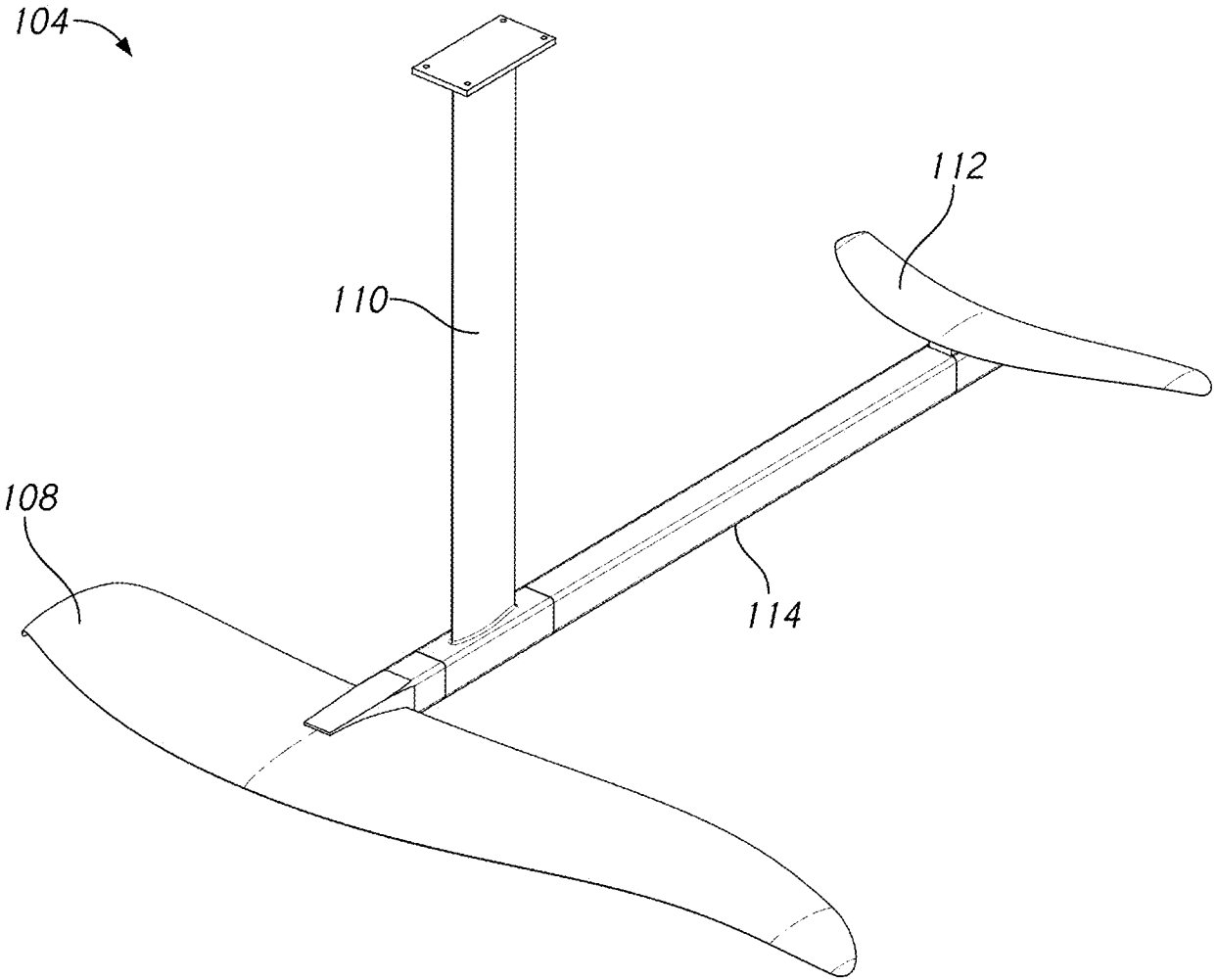
FIG. 3A illustrates an exemplary hydrofoil used in the hydrofoil system shown in FIGS. 2A-2E.
Figure 3B:
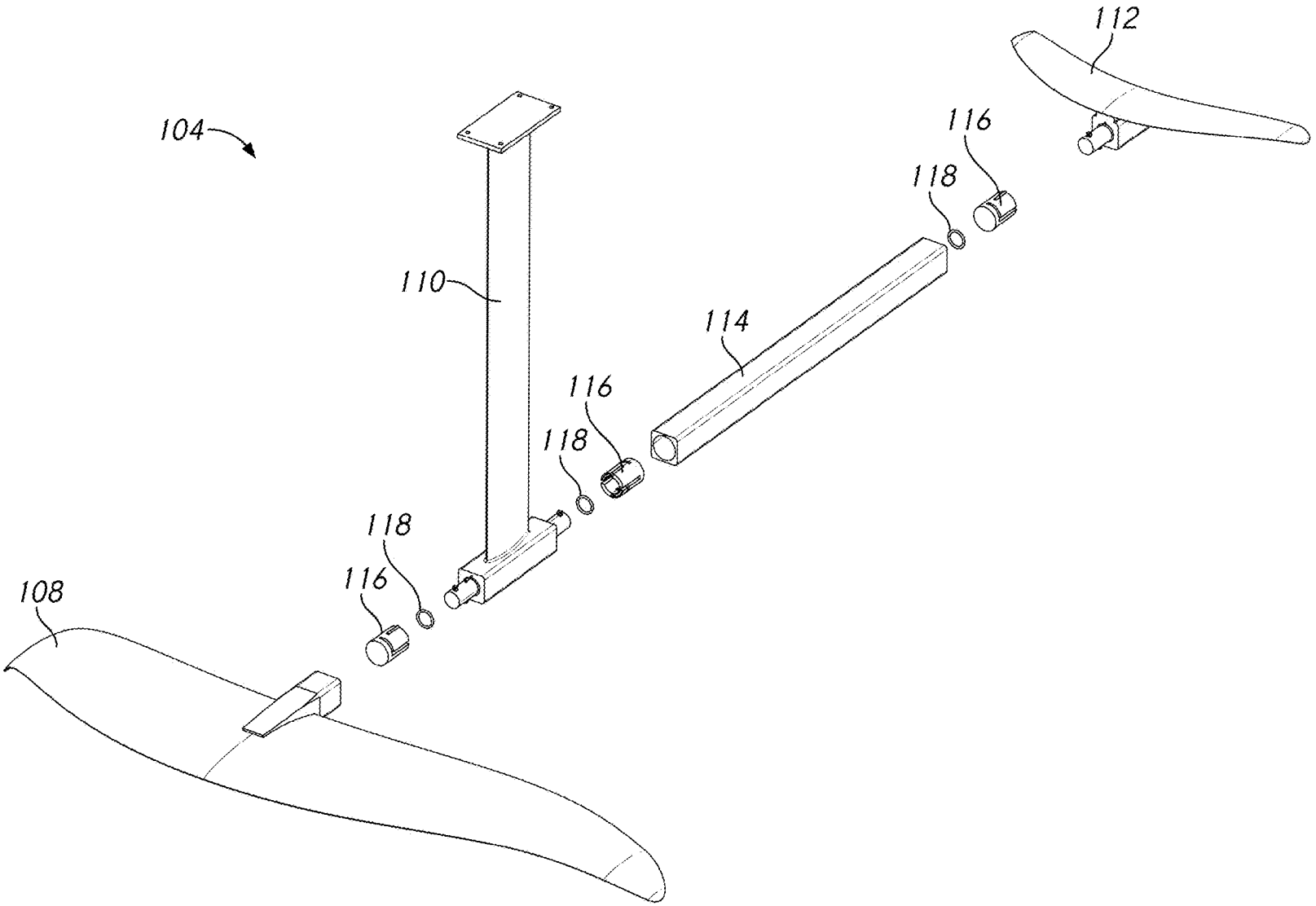
FIG. 3B illustrates an exploded view of the hydrofoil shown in FIG. 3A.

FIG. 3A illustrates the hydrofoil 104 detached from the surfboard 102. The hydrofoil 104 may include a front wing 108, a mast assembly 110, a shaft housing 114, and/or a rear wing 112. Any of these components may be integrated with or removably joined to one of the other components of the hydrofoil 104 by toolless connections. For example, as shown in FIG. 3B, a front portion of the mast assembly 110 may be removably joined to a rear portion of the front wing 108. A front portion of the shaft housing 114 may be removably joined to a rear portion of the mast assembly 110. A front portion of the rear wing 112 may be removably joined to a rear portion of the shaft housing 114. Each of the separate components may be toollessly joined together without the use of any bolts or screws. When the hydrofoil components are joined together, the connection features may be entirely internal to an exterior surface of the hydrofoil without any fasteners exposed or visible on an exterior surface of the hydrofoil (see FIG. 3A). The connection features may be integrated with or separately joined to each of the front wing 108, the mast assembly 110, the shaft housing 114, and/or the rear wing 112. The hydrofoil components may be secured together by rotating the components relative to each other, for example less than or equal to about 180 degrees, or less than or equal to about 90 degrees, relative to each other. As described herein, the hydrofoil components may be toollessly joined together using a keyed connector 116 corresponding connection features. One or more seals 118 may be provided between components of the hydrofoil 104.

Methods of assembling the hydrofoil can include connecting various components of the hydrofoil with toolless connections. Each toolless connection can be secured by inserting a connection portion on a first component into a keyed connector on a second component and rotating the first component relative to the second component to prevent axial and/or radial movement between the first component and the second component. For example, the method can include inserting a first or front connection portion 140 on the mast assembly 110 into a keyed connector 116 in the front wing 108 and rotating the mast assembly 110 relative to the front wing 108. The method can include inserting a second or rear connection portion 142 on the mast assembly 110 into a keyed connector 116 in the shaft housing 114 and rotating the shaft housing 114 relative to the mast assembly 110. The method can include inserting a connection portion 168 on the rear wing 112 into a keyed connector 116 in the shaft housing 114 and rotating the rear wing 112 relative to the shaft housing 114. Each rotational step can include rotating the hydrofoil components by less than or equal to about 360 degrees (or less than or equal to about 270 degrees, or less than or equal to about 180 degrees, or less than or equal to about 90 degrees) to prevent axial and/or radial movement of the hydrofoil components. Although the keyed connectors and connection portions are described as being on particular components, the arrangement of keyed connectors and connection portions could be reversed. The hydrofoil components may be toollessly disassembled by reversing the steps described herein.

As described in more detail below, each toolless connection may include a connection portion on a first component of the hydrofoil and a keyed connector on a second component of the hydrofoil. The keyed connector is configured to mate with the connection portion. The connection portion can include a connector body. The keyed connector can include a body defining a lumen. The keyed connector can include one or more first connection features configured to interface or interlock with corresponding first connection feature(s) on the connection portion to prevent axial movement between the keyed connector and the connection portion. The keyed connector can include one or more second connection features configured to interface with a corresponding second connection(s) feature on the connection portion to prevent radial movement between the keyed connector and the connection portion, for example by a press fit or a snap fit. The keyed connector can include an alignment feature configured to interface with a corresponding alignment feature on the hydrofoil component in which the key connector is positioned and/or the connection portion to provide alignment. The toolless connection can include a seal between the keyed connector and the connection portion.

Figure 4:
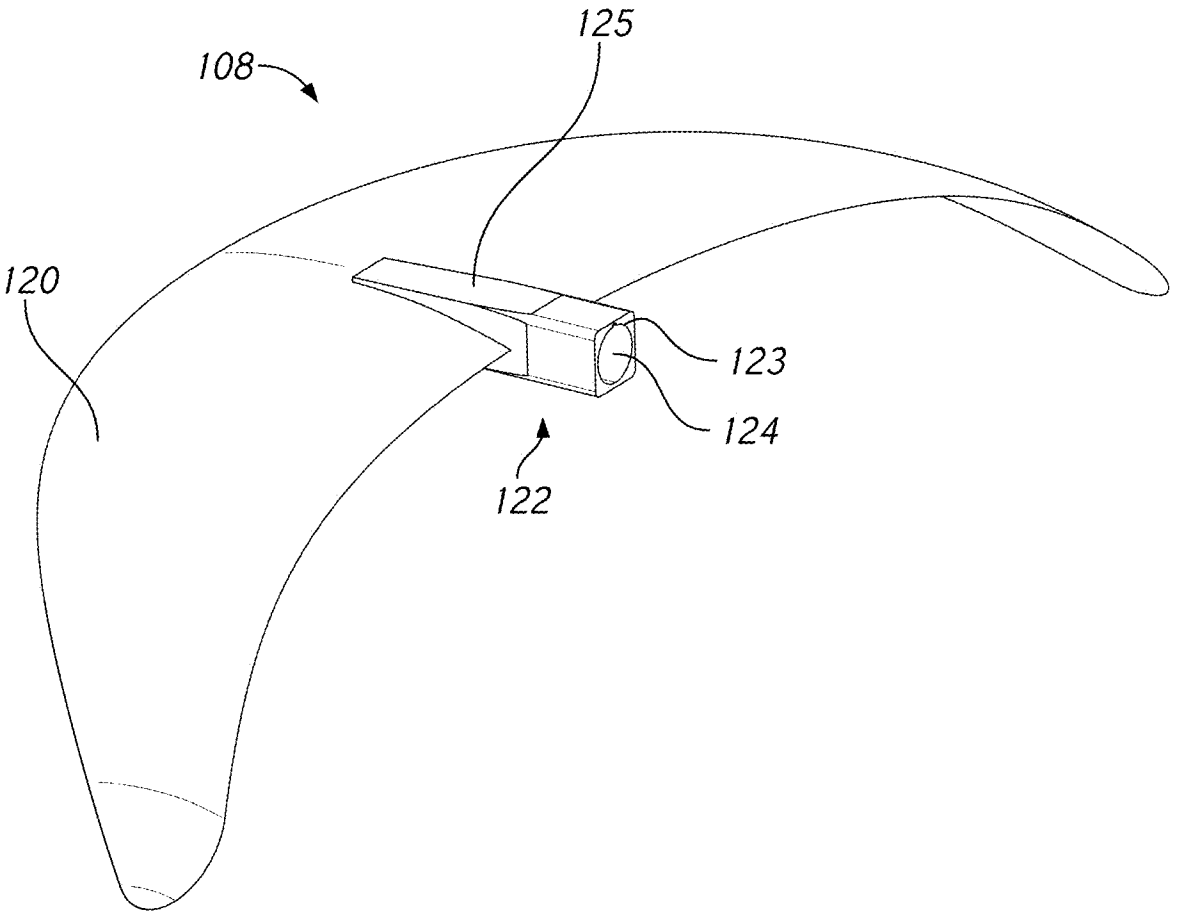
FIG. 4 illustrates an exemplary front wing for use with the hydrofoil shown in FIG. 3A.

FIG. 4 illustrates an exemplary front wing 108 configured to be positioned on a front end of the hydrofoil 104. The front wing 108 may include a wing body 120 and a connection portion 122 for attachment to a corresponding first or front connection portion 140 on the mast assembly 110 (see FIG. 6A). The connection portion 122 may extend from a rear side of the wing body 120. The connection portion 122 may include a connector body 125 defining a lumen 124. The lumen 124 may receive a projection of the corresponding first or front connection portion 140 on the mast assembly 110 (see FIG. 6B). The lumen 124 may include a notch 123 projecting radially from the lumen 124, described in more detail below with respect to FIGS. 9A-9C. A cross-sectional profile of the connector body 125 may be a different shape from a cross-sectional profile of the lumen 124. For example, the connector body 125 may have a generally polygonal cross-sectional profile and the lumen 124 may have a generally circular cross-sectional profile of the lumen 124. The connector body 125 may include one or more chamfered edges.

A mass of the front wing 108 may be less than or equal to 10 lbs., or less than or equal to about 9 lbs., or less than or equal to about 8 lbs. A surface area of the front wing 108 may be less than or equal to about 1000 sq. inches, or less than or equal to about 750 sq. inches, or less than or equal to about 700 sq. inches, or less than or equal to about 600 sq. inches, or less than or equal to about 500 sq. inches. A volume of the front wing 108 may be less than or equal to about 500 cubic inches, or less than or equal to about 250 cubic inches, or less than or equal to about 200 cubic inches, or less than or equal to about 150 cubic inches. A density of the front wing 108 may be less than or equal to about 0.1 pounds per cubic inch, or less than or equal to about 0.05 pounds per cubic inch.

Although FIG. 4 illustrates a lumen 124 that may receive a projection on the mast assembly 110, in other configurations, connection features on the front wing 108 and the mast assembly 110 may be reversed such that features of the connection portion 122 may be present on the mast assembly 110. For example, the mast assembly 110 may include a lumen configured to receive a projection on the front wing 108.

As explained above, the front wing 108 may be joined to the mast assembly 110 using one or more internal connectors that may be assembled without any tools. For example, the toolless connections described herein may include a keyed connector 116, shown in FIG. 5. The keyed connector 116 may include a body 126 defining a lumen 130 for receiving a corresponding projection. In other configurations, the body 126 may include a projection for receipt by a corresponding lumen.

Figure 5:
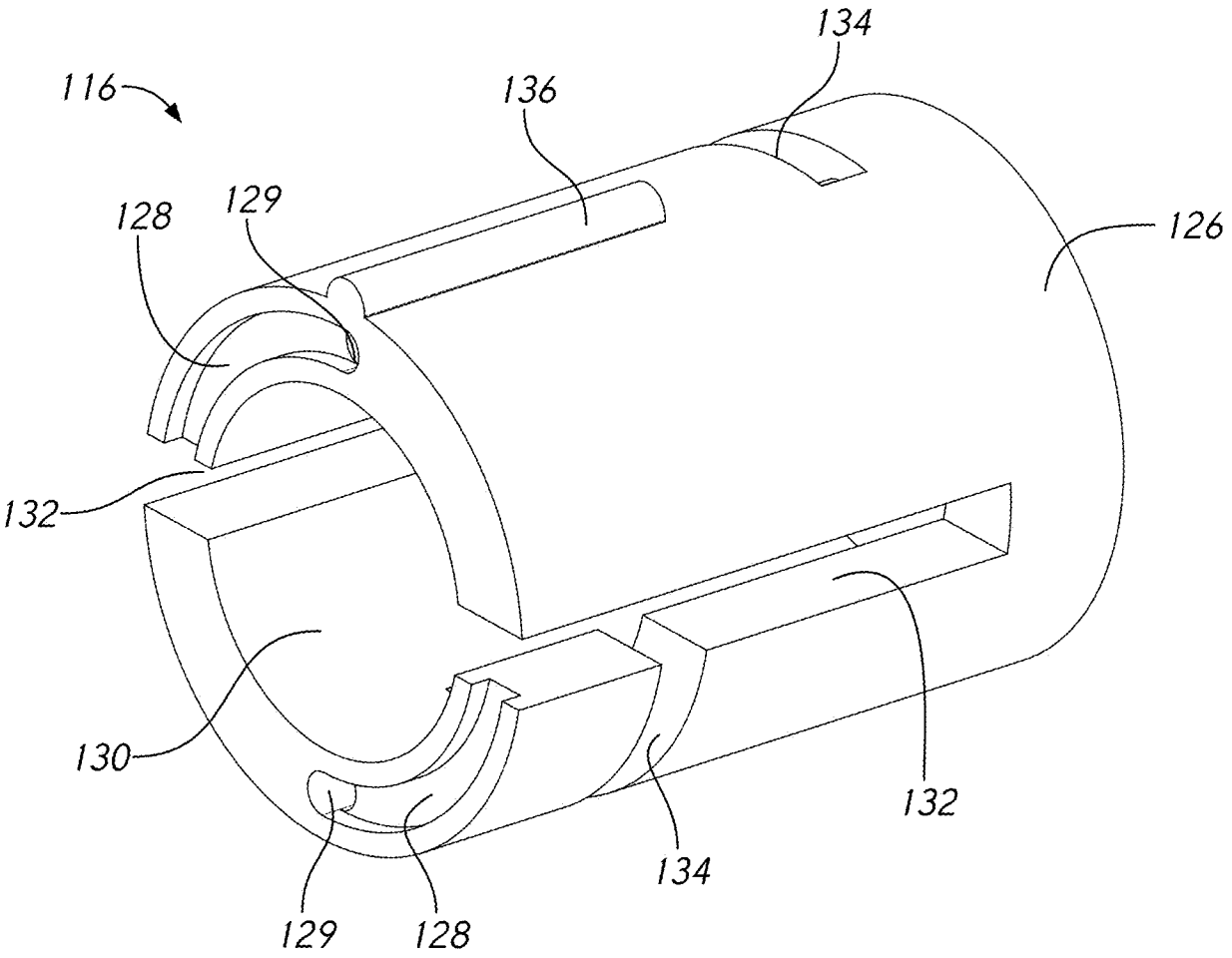
FIG. 5 illustrates an exemplary keyed connector for use with the hydrofoil shown in FIG. 3A.

The keyed connector 116 may include one or more connection features to resist or prevent movement between the front wing 108 and the mast assembly 110. For example, the body 126 may include a first connection feature to resist or prevent axial movement between the front wing 108 and the mast assembly 110. The first connection feature may include one or more passageways 132, 134. The passageways 132, 134 may extend at least a partial thickness or a full thickness of the body 126. As shown in FIG. 5, the first connection feature may include a first passageway 132 extending in an axial direction along at least a partial length of the body 126 and/or a second passageway 134 extending in a radial direction along at least a partial circumference of the body 126. The first passageway 132 may be bounded at one end and open at the other end to an end face of the body 126. The second passageway 134 may intersect with the first passageway 132. The second passageway 134 may be bounded at one end and open at the other end to the first passageway 132. The body 126 may include one or more combinations of the first and second passageways 132, 134. For example, as shown in FIG. 5, the keyed connector 116 may include two sets of the first and second passageways 132, 134. When more than one sets of passageways 132, 134 are present, the second passageways 134 may be axially offset from each other and/or the first passageways 132 may be circumferentially spaced apart but axially aligned. For example, the keyed connector 116 may include two diametrically opposed first passageways 132. In other configurations, the keyed connector 116 include one or more projections configured to be received by a corresponding passageway.

The keyed connector 116 may include a second connection feature to resist or prevent radial movement between the front wing 108 and the mast assembly 110. The body 126 may include the second connection feature on an end face of the body 126. For example, the second connection feature may include a one or more grooves 128 on a rear face of the body 126. Each groove 128 may have an arcuate profile. The groove 128 may be bounded at one end and open at the other end, for example open to the passageway 132. Each groove 128 may include a socket 129 at the bounded end of the groove 128. The socket 129 may extend further than the remainder of the groove 128 in the axial direction. In other configurations, the second connection feature may include a projection extending from an end face of the body 126.

The keyed connector 116 may include an alignment feature to provide alignment between the keyed connector 116 and the front wing 108. The alignment feature may include a projection 136 extending from the body 126. The projection 136 may extend along a partial length of the body 126 in the axial direction. The projection 136 may include an arcuate profile in the radial direction. Although the alignment feature is illustrated as a projection 136, the alignment feature may instead include a groove.

Although the keyed connector 116 is described with respect to the front wing 108, the keyed connector 116 may be positioned within a lumen of any of the hydrofoil components (see FIG. 3B). For example, the keyed connector 116 may be at least partially disposed within a lumen of the mast assembly 110 to receive a projection on the front wing 108. Any of the connections described herein may be reversed. Moreover, although the keyed connector 116 is illustrated as a separate component from the front wing 108, the keyed connector 116 may be integrated within the lumen 124 of the front wing 108 or other component of the hydrofoil 104.

Figure 6A:
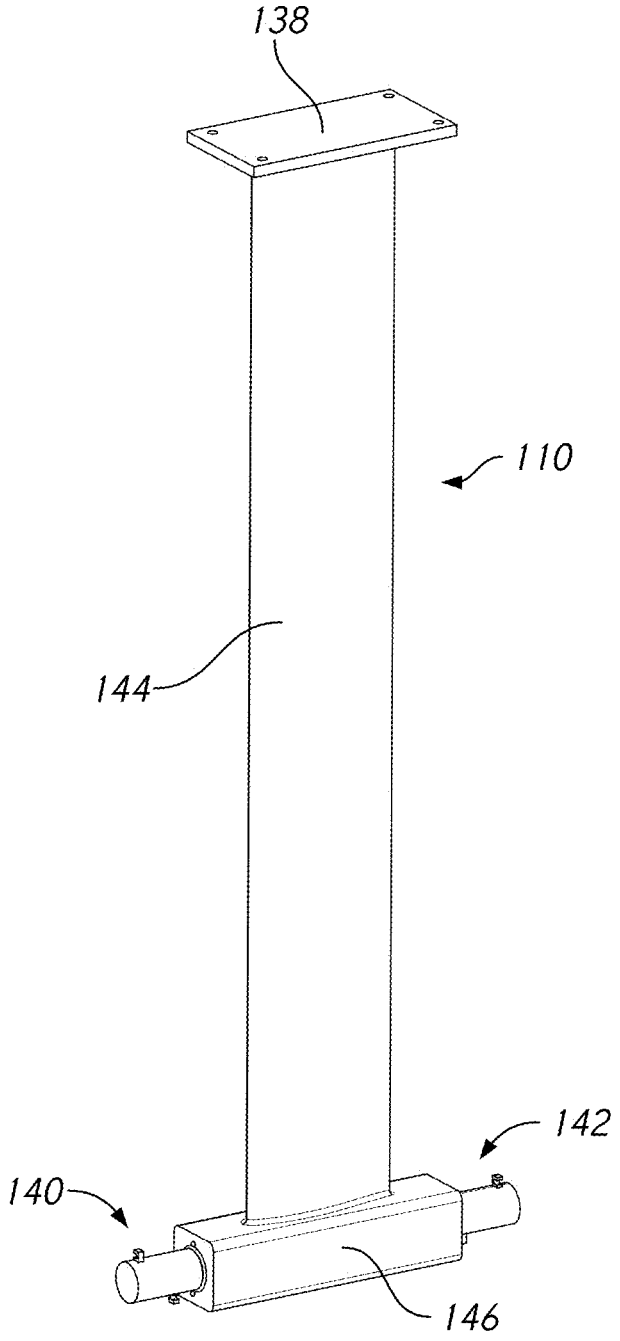
FIG. 6A illustrates an exemplary mast assembly for use with the hydrofoil shown in FIG. 3A.

FIG. 6A illustrates a mast assembly 110 configured to be positioned between the front wing 108 and the shaft housing 114 or the rear wing 112. The mast assembly 110 may include an elongate body 144 extending in a vertical direction. The mast assembly 110 may include a mounting end 138 at an upper end of the elongate body 144 to be mounted to a surfboard 102. The mast assembly 110 may include a connector end 146 opposite the mounting end 138. The mast assembly 110 may include a front connection portion 140 on a front side of the connector end 146 for connection to the front wing 108. The mast assembly 110 may include a rear connection portion 142 on a rear side of the connector end 146 for connection to the shaft housing 114 or the rear wing 112. The front connection portion 140 may be similar to the rear connection portion 142. The cross-sectional shape of the connector end 146 may be similar to the cross-sectional shape of the connector body 125 of the front wing 108 so that the connector body 125 and the connector end 146 form a continuous elongate structure when assembled.

A mass of the mast assembly 110 may be less than the mass of the front wing 108. For example, the mass of the mast assembly 110 may be less than or equal to 10 lbs., or less than or equal to about 9 lbs., or less than or equal to about 8 lbs., or less than or equal to about 7 lbs. A surface area of the mast assembly 110 may be less than or equal to the surface area of the front wing 108. The surface area of the mast assembly 110 may be less than or equal to about 500 sq. inches, or less than or equal to about 450 sq. inches, or less than or equal to about 400 sq. inches, or less than or equal to about 350 sq. inches. A volume of the mast assembly 110 may be less than or equal to the volume of the front wing 108. The volume of the mast assembly 110 may be less than or equal to about 150 cube inches, or less than or equal to about 100 cubic inches, or less than or equal to about 75 cubic inches, or less than or equal to about 50 cube inches. A density of the mast assembly 110 may be less than or equal to about 0.1 pounds per cubic inch, or less than or equal to about 0.08 pounds per cubic inch.

Figure 6B:
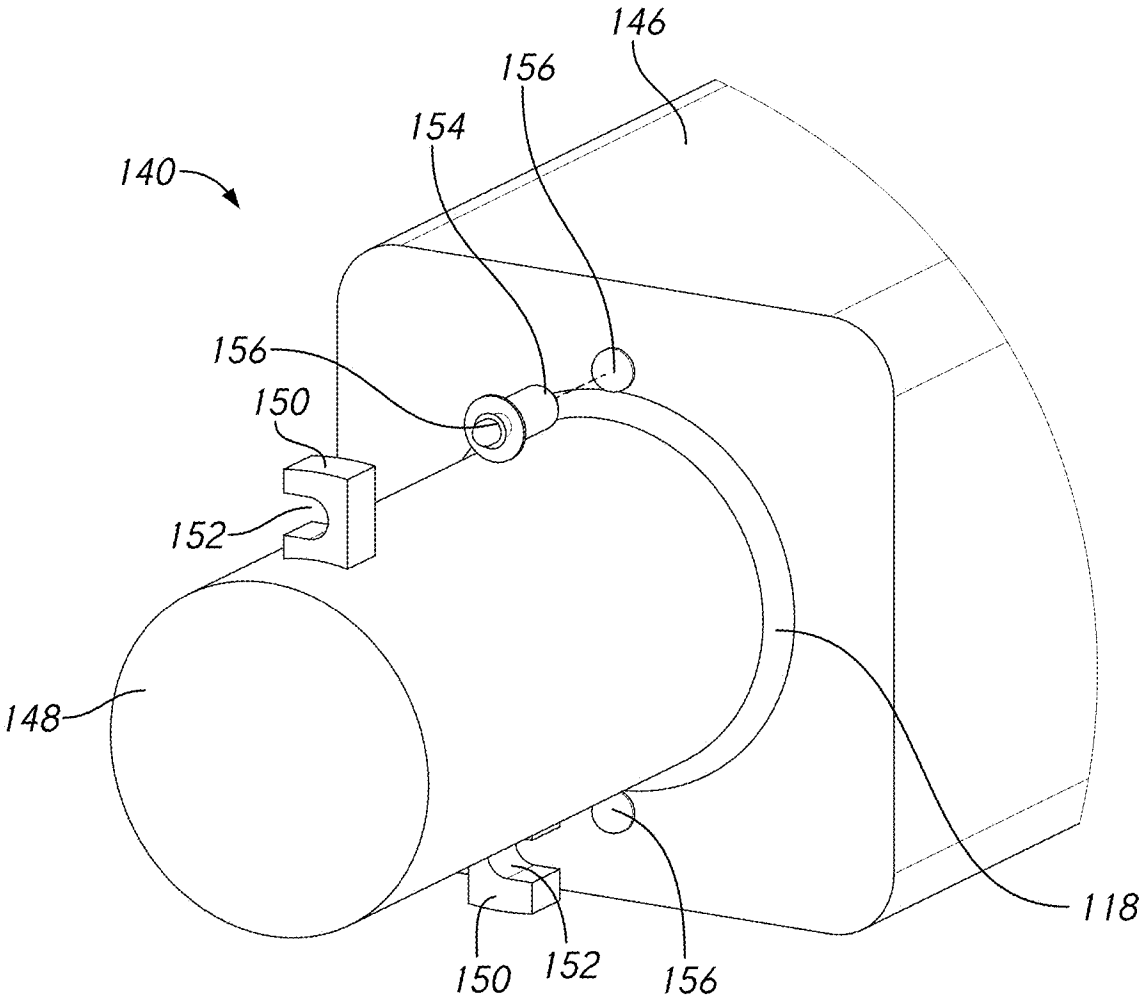
FIG. 6B illustrates an enlarged view of an exemplary attachment portion for use with the mast assembly shown in FIG. 6A.

FIG. 6B illustrates an enlarged view of the front connection portion 140. The rear connection portion 142 may include any of the features of the front connection portion 140.

The front connection portion 140 may include a connector body 148 projecting from the connector end 146. An outer cross-sectional profile of the connector end 146 may be a different shape from an outer cross-sectional profile of the connector body 148. For example, the connector end 146 may have a polygonal cross-sectional profile, and the connector body 148 may have a circular cross-sectional body.

The front connection portion 140 may include one or more connection features to resist or prevent movement between the front wing 108 and the mast assembly 110. For example, the front connection portion 140 may include a first connection feature to resist or prevent axial movement between the front wing 108 and the mast assembly 110. The first connection feature may include one or more projections 150 extending from the connector body 148. When more than one projection 150 is present, the projections 150 may be circumferentially and/or axially offset along the connector body 148. Each projection 150 may include a cutout 152 keyed to interface or interlock with the corresponding passageway in the keyed connector 116. When the front connection portion 140 includes more than one projection 150, the cutouts 152 may face different directions. Although the first connection feature is illustrated as a projection 150, the first connection feature may instead include a groove or passageway.

The front connection portion 140 may include a second connection feature to resist or prevent radial movement between the front wing 108 and the mast assembly 110. The front connection portion 140 may include the second connection feature on an end face of the connector end 146. For example, the second connection feature may include a one or more protrusions 156 on the face of the connector end 146. The one or more protrusions 156 may be displaced from the end face of connector body 148. Each protrusion 156 may include a rounded or ball-shaped profile. The second connection feature may include two circumferentially spaced apart protrusions 156. The protrusions 156 may be diametrically positioned on opposite sides of the connector body 148. As shown in FIG. 6B, the protrusion 156 may be disposed on a pin 154 received in the front face of the connector end 146. The pin 154 may be press-fit into the connector end 146. In other configurations, the protrusion 156 may be integral with the connector end 146. As shown in FIG. 6B, a seal 118, such as an O-ring, may be disposed about the connector body 148. The seal 118 may be seated radially between the connector body 148 and the protrusion(s) 156.

Figure 7:
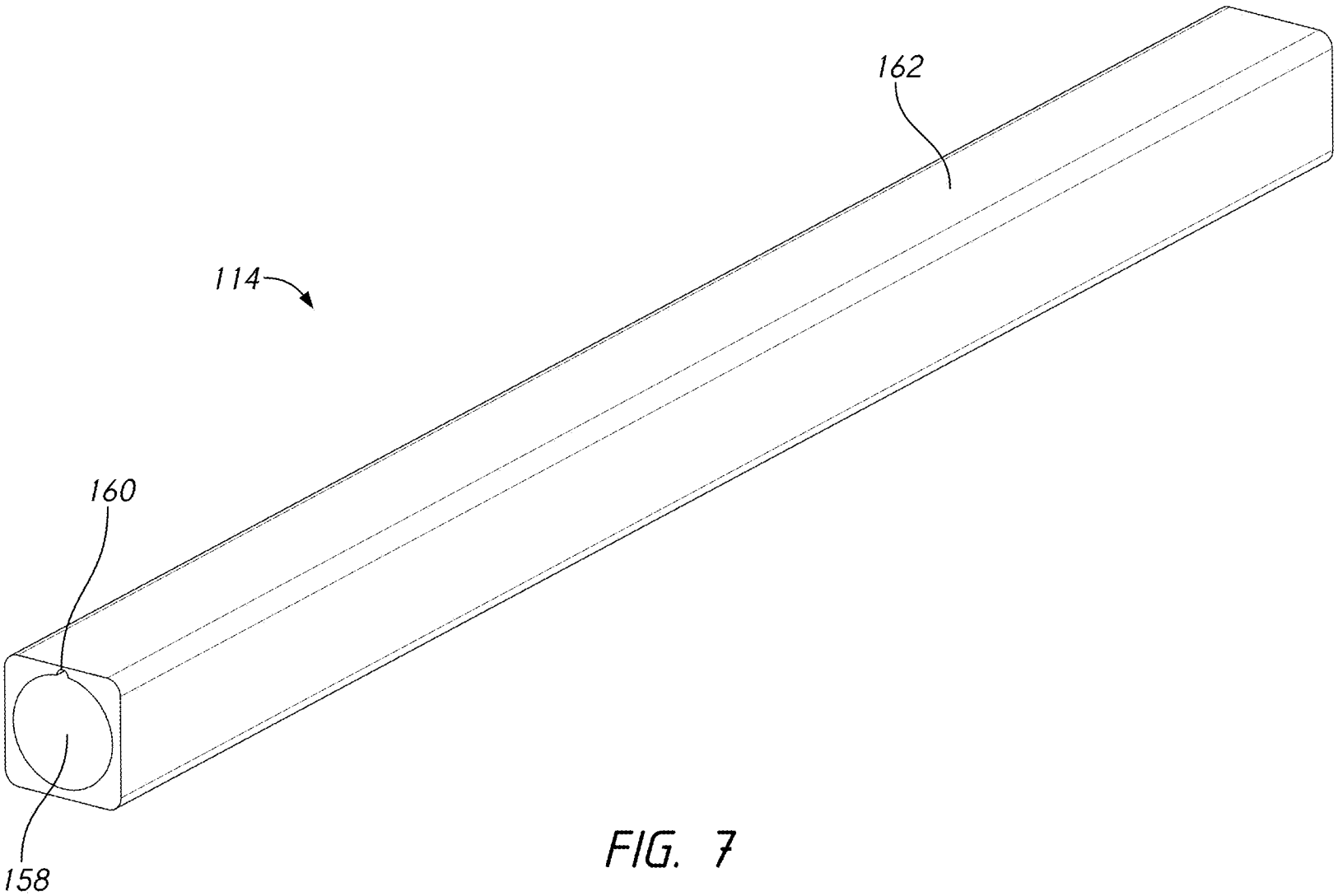
FIG. 7 illustrates an exemplary shaft housing for use with the hydrofoil shown in FIG. 3A.

FIG. 7 illustrates a shaft housing 114 configured to extend between the mast assembly 110 and the rear wing 112. A first end of the shaft housing 114 may be configured to receive or interface with the rear connection portion 142 on the mast assembly 110. A second end of the shaft housing 114 may be configured to receive or interface with the connection portion 168 of the rear wing 112. Although only one end of the shaft housing 114 is shown in FIG. 7, the opposite end may be the same as the end shown in FIG. 7. The shaft housing 114 may include an elongate body 162 defining a lumen 158. The lumen 158 may extend the entire length of the shaft housing 114, or the lumen 158 may include multiple portions extending from an end portion and along a partial length of the elongate body 162. The lumen 158 may include an alignment feature, for example a notch 160 extending radially from the lumen 158. A cross-sectional shape of the elongate body 162 may be a different shape from a cross-sectional shape of the lumen 158. For example, the elongate body 162 may include a generally polygonal cross-sectional shape and the lumen 158 may include a generally circular cross-sectional shape. The cross-sectional shape of the elongate body 162 may be similar to the cross-sectional shape of the connector end 146. The shaft housing 114 may include one or more chamfered edges.

A mass of the shaft housing 114 may be less than the mass of the front wing 108. A mass of the shaft housing 114 may be greater than the mass of the mast assembly 110. For example, the mass of the shaft housing 114 may be less than or equal to 10 lbs., or less than or equal to about 9 lbs., or less than or equal to about 8 lbs., or less than or equal to about 7 lbs. A surface area of the shaft housing 114 may be less than or equal to the surface area of the front wing 108 or the mast assembly 110. The surface area of the shaft housing 114 may be less than or equal to about 500 sq. inches, or less than or equal to about 450 sq. inches, or less than or equal to about 400 sq. inches, or less than or equal to about 350 sq. inches, or less than or equal to about 300 sq. inches, or less than or equal to about 250 sq. inches, or less than or equal to about 200 sq. inches. A volume of the shaft housing 114 may be less than or equal to the volume of the front wing 108 or the mast assembly 110. The volume of the shaft housing 114 may be less than or equal to about 150 cubic inches, or less than or equal to about 100 cubic inches, or less than or equal to about 75 cubic inches, or less than or equal to about 50 cubic inches. A density of the shaft housing 114 may be less than or equal to about 0.1 pounds per cubic inch.

Figure 8:
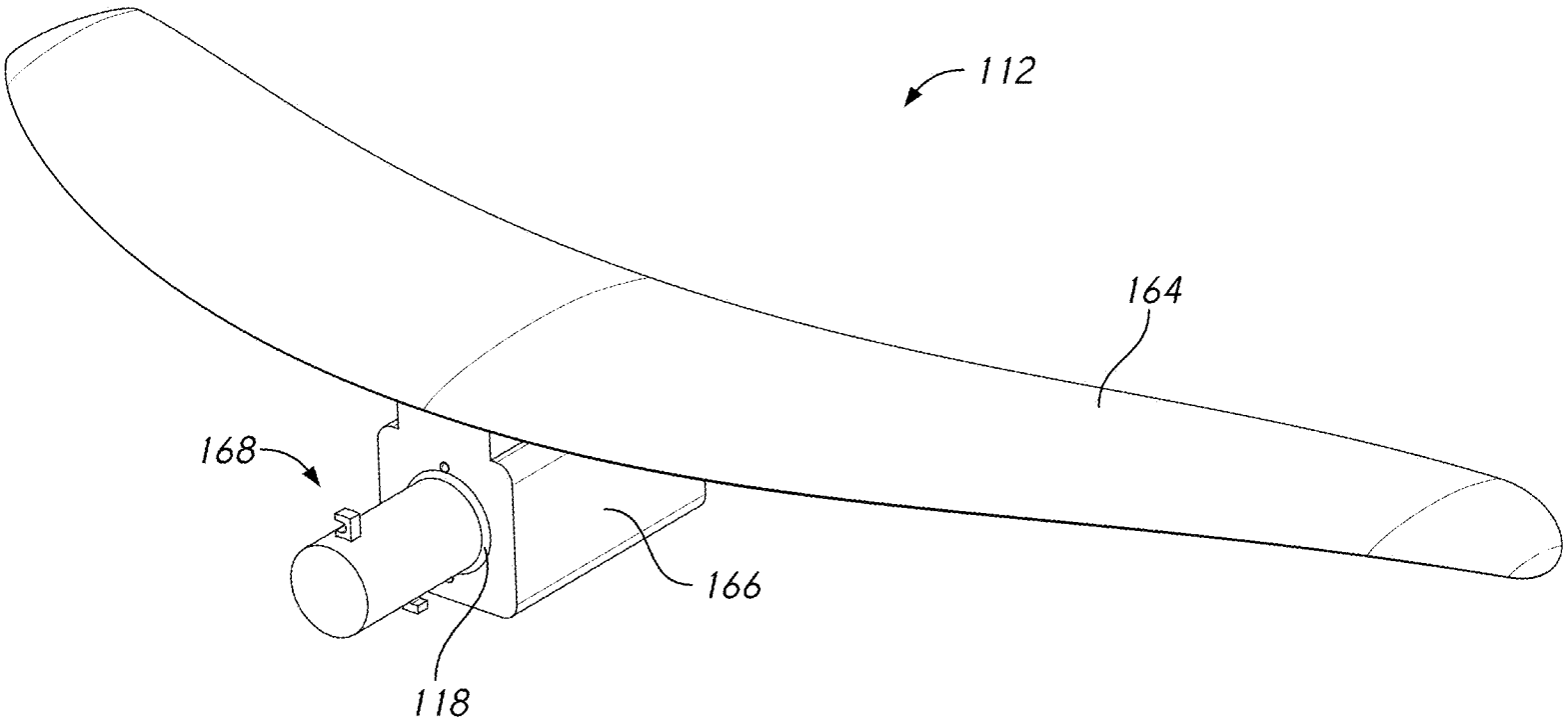
FIG. 8 illustrates an exemplary rear wing for use with the hydrofoil shown in FIG. 3A.

FIG. 8 illustrates a rear wing 112 configured to be positioned at a rear end of the hydrofoil 104. The rear wing 112 may include a wing body 164 and a connection body 166. The rear wing 112 may include a connection portion 168 extending forward of the connection body 166 for connection to the shaft housing 114. The connection portion 168 may include any of the features of the front connection portion 140 shown in FIG. 6B.

A mass of the rear wing 112 may be less than any of the other components of the hydrofoil 104. For example, the mass of the rear wing 112 may be less than or equal to 5 lbs., or less than or equal to about 4 lbs., or less than or equal to about 3 lbs., or less than or equal to about 2.5 lbs. A surface area of the rear wing 112 may be less than or equal to the surface area of any of the other components of the hydrofoil 104. The surface area of the rear wing 112 may be less than or equal to about 500 sq. inches, or less than or equal to about 400 sq., inches, or less than or equal to about 300 sq. inches, or less than or equal to about 250 sq. inches, or less than or equal to about 200 sq. inches, or less than or equal to about 150 sq. inches. A volume of the rear wing 112 may be less than or equal to the volume of any of the other components of the hydrofoil 104. The volume of the rear wing 112 may be less than or equal to about 100 cubic inches, or less than or equal to about 75 cubic inches, or less than or equal to about 50 cubic inches. A density of the rear wing 112 may be less than or equal to about 0.1 pounds per cubic inch.

Figure 9A:
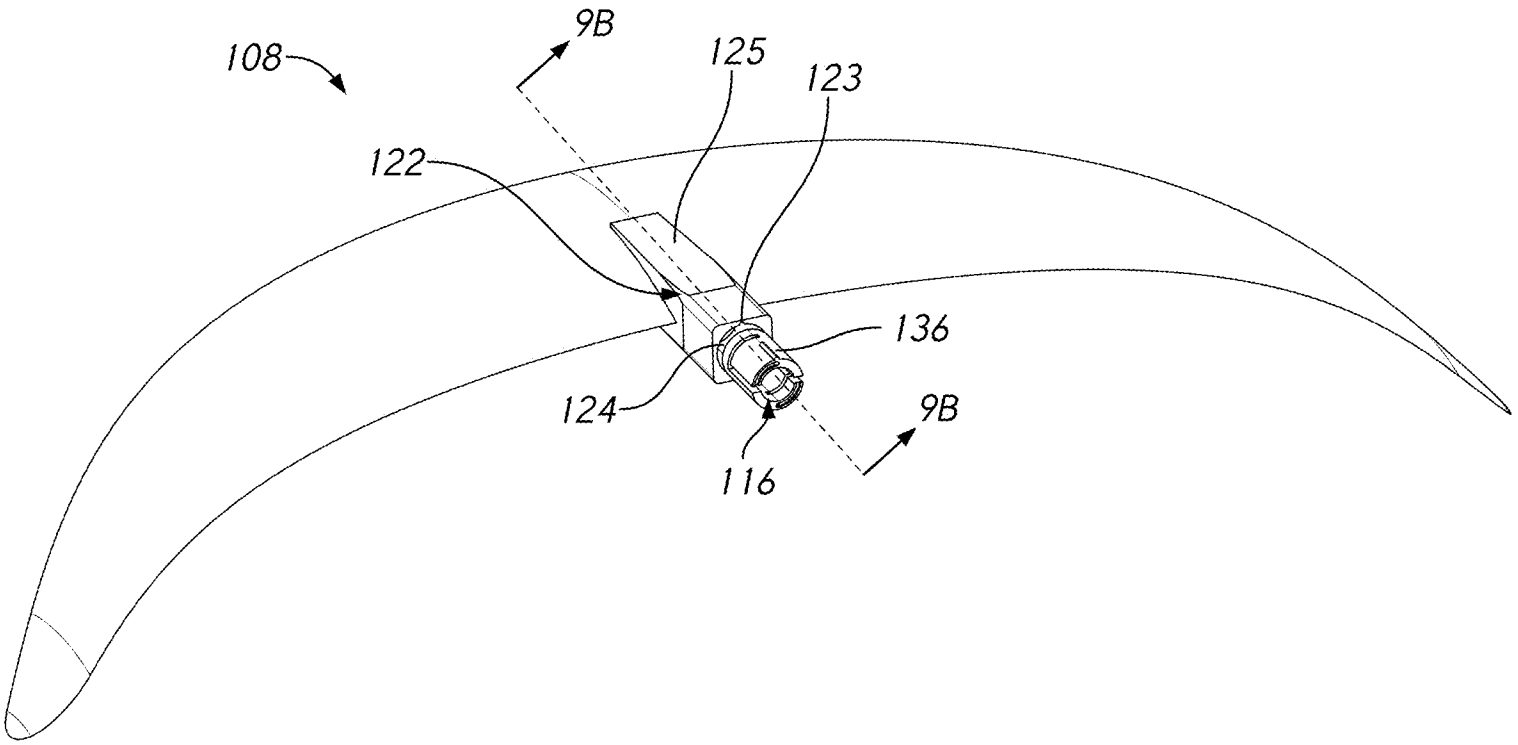
FIGS. 9A-9C illustrate exemplary details of assembling a sub-assembly of the hydrofoil including the front wing shown in FIG. 4 and the keyed connector shown in FIG. 5.
Figure 9B:
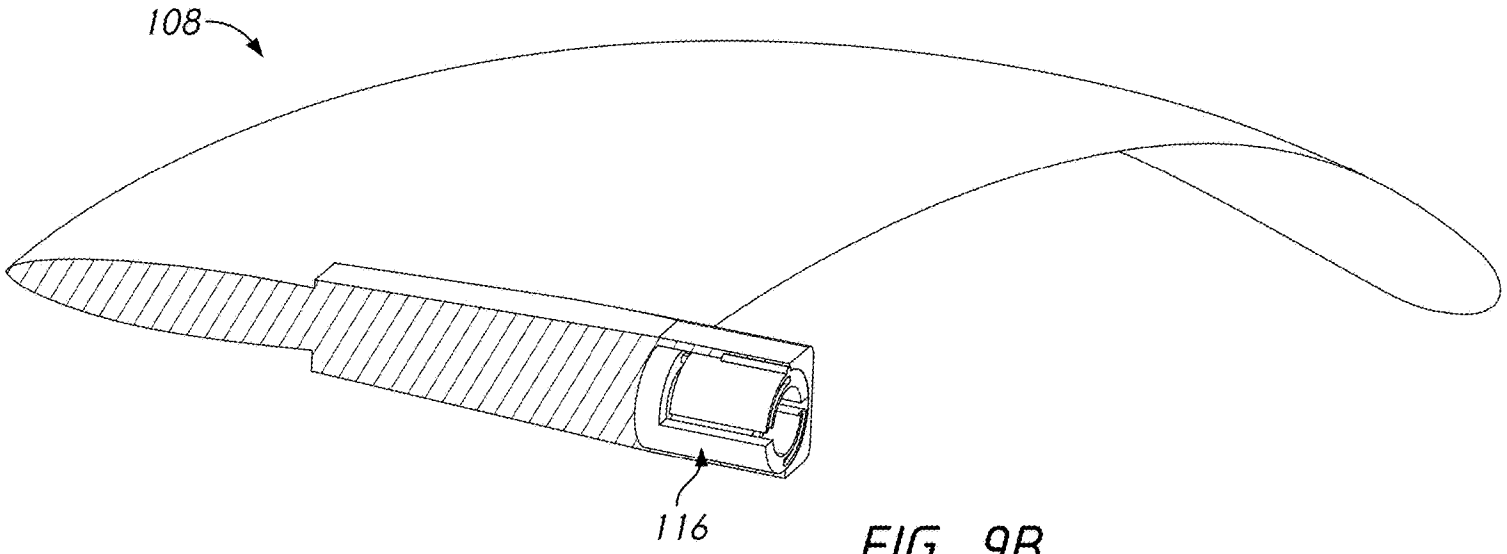
Figure 9C:
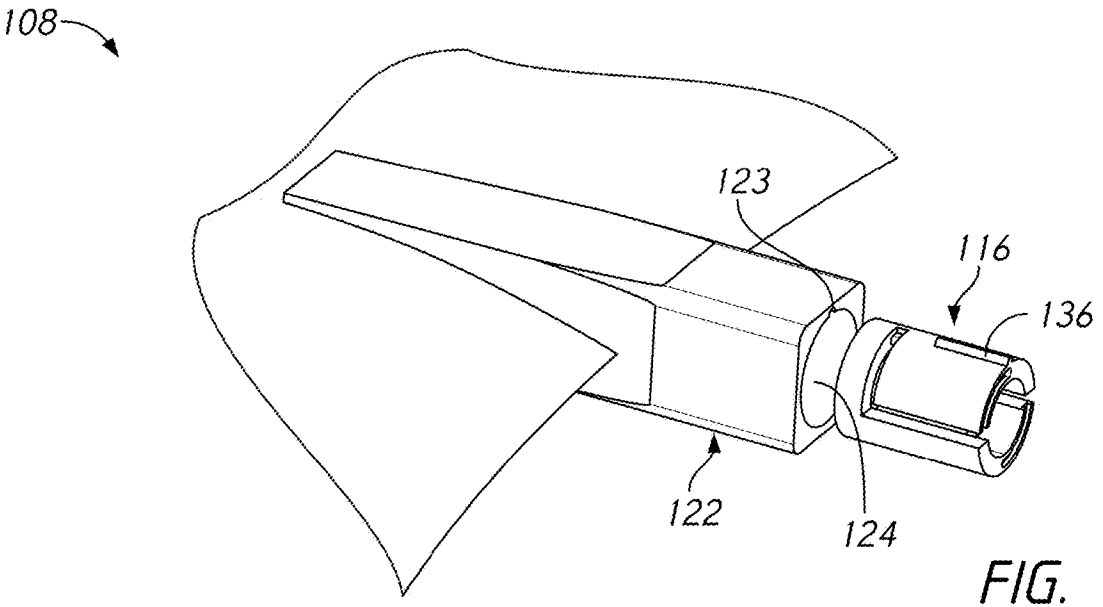

FIGS. 9A-9C illustrate the sub-assembly of the front wing 108 and the keyed connector 116. As shown in FIG. 9A, the lumen 124 of the connection portion 122 may receive the keyed connector 116. The keyed connector 116 may be received in only one or more pre-determined orientations. As explained above, the front wing 108 and the keyed connector 116 may include corresponding alignment features that mate with each other. The connection portion 122 may include an alignment notch 123 configured to receive an alignment projection 136 on the keyed connector 116. Although FIG. 9A illustrates a single alignment notch 123, the connection portion 122 may include additional notches to permit one or more additional orientations between the keyed connector 116 and the front wing 108. When assembled, the keyed connector 116 may form a press fit with the connection portion 122 of the front wing 108. In some implementations, the keyed connector 116 may be permanently joined to the front wing 108, for example using an adhesive.

Although FIGS. 9A-9C illustrate the alignment notch 123 on the connection portion 122 and the alignment projection 136 on keyed connector 116, but in other configurations, the connection portion 122 may include the alignment projection and the keyed connector 116 may include the alignment notch. In yet other configurations, the sub-assembly of the front wing 108 and the keyed connector 116 may include no alignment features with the keyed connector 116 insertable at any position within the front wing 108.

Figure 10:
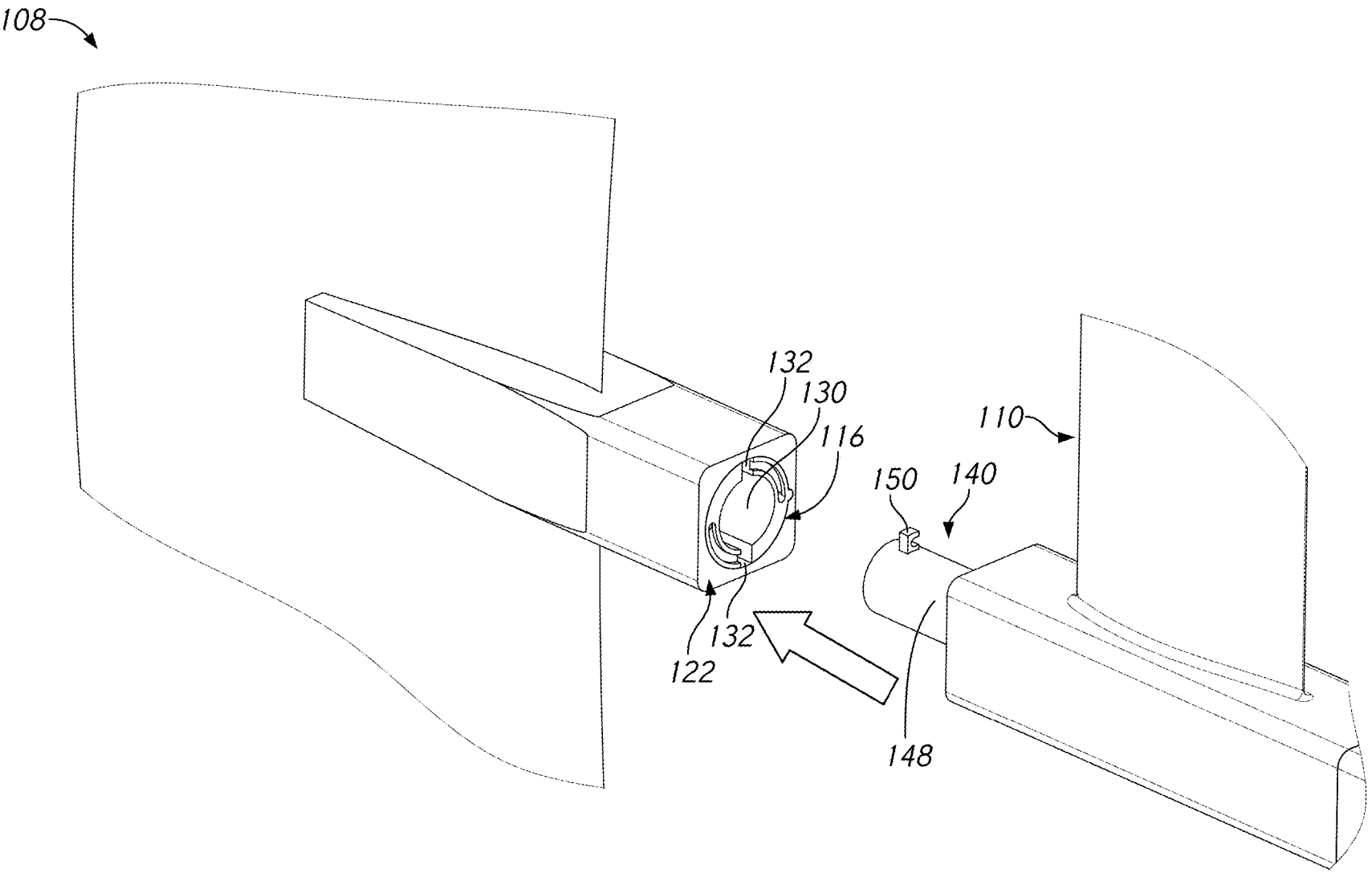
FIG. 10 illustrates exemplary details of assembling the sub-assembly shown in FIGS. 9A-9C and the mast assembly shown in FIGS. 6A-6B.

FIG. 10 illustrates the assembly between the front wing 108 and the mast assembly 110. The connection portion 122 of the front wing 108 with the keyed connector 116 may receive the front connection portion 140 of the mast assembly 110. In particular, the lumen 130 of the keyed connector 116, disposed within the connection portion 122, may receive the connector body 148 of the front connection portion 140. One or more first passageways 132 in the keyed connector 116 may receive one or more projections 150 on the connector body 148 in an axial direction. For assembly, the front wing 108 may be rotated relative to the mast assembly 110 from its ordinary position in use, for example by less than or equal to 360 degrees (or less than or equal to about 270 degrees, or less than or equal to about 180 degrees, or less than or equal to 90 degrees, or less than or equal to 45 degrees, or otherwise), for the one or more second passageways 134 to receive the corresponding projections 150 on the connector body 148.

Figure 11B:
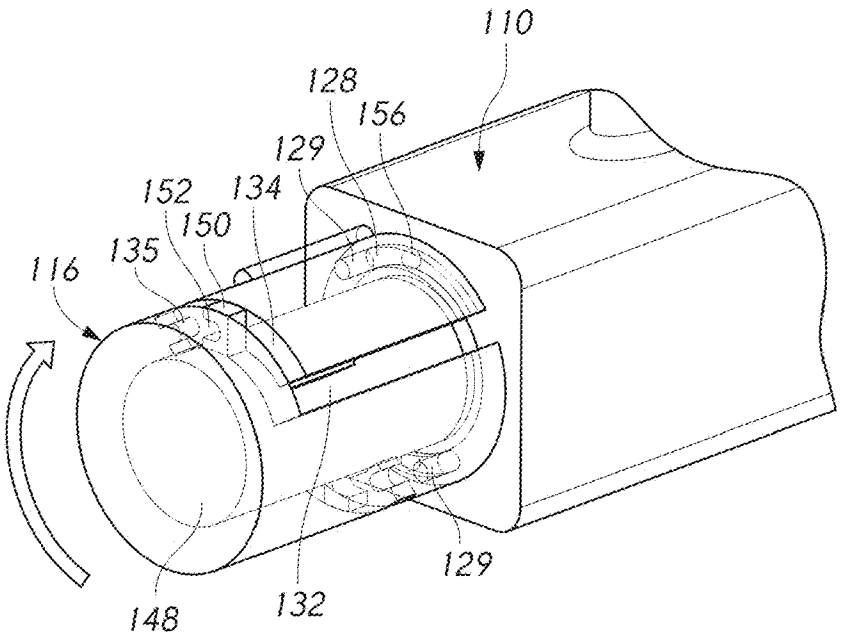
FIGS. 11A-11E illustrate exemplary details of assembling a sub-assembly of the hydrofoil including the keyed connector shown in FIG. 5 and the mast assembly shown in FIGS. 6A-6B.
Figure 11A:
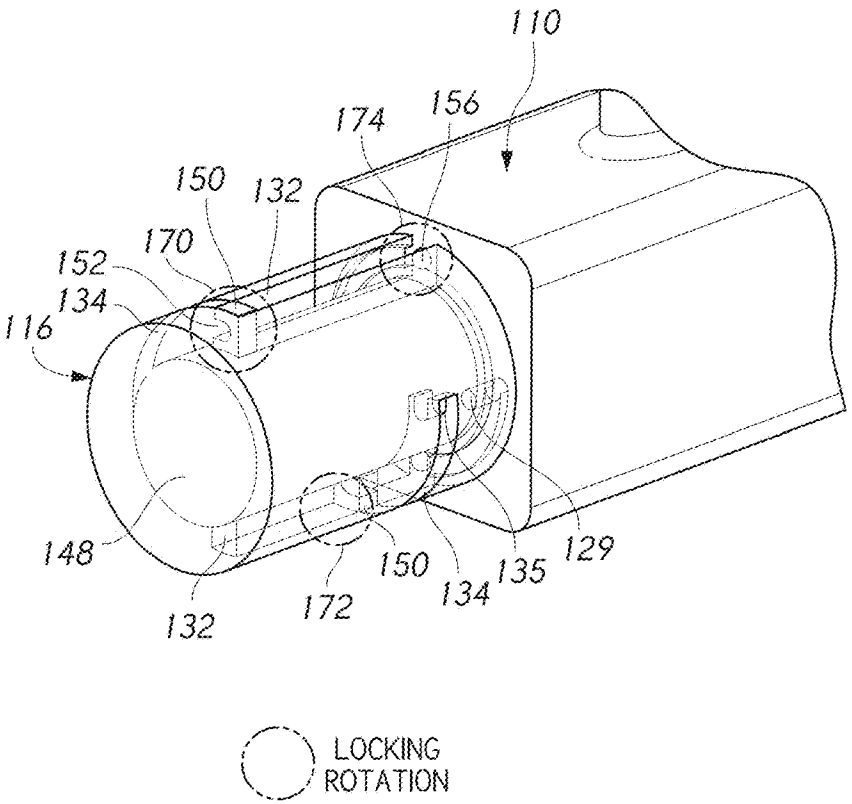
Figure 11D:
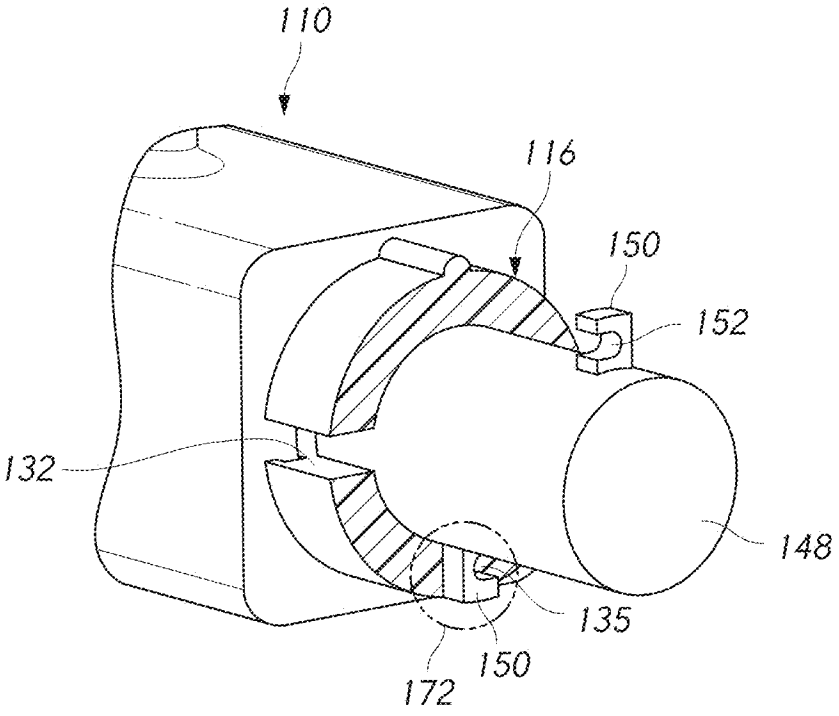
Figure 11C:
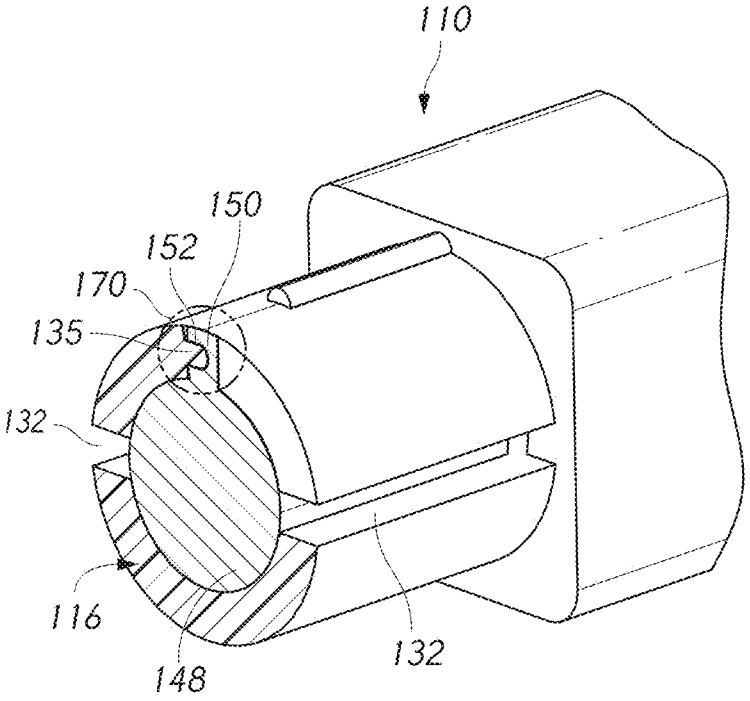

FIGS. 11A and 11B illustrate the assembly of the keyed connector 116 and the mast assembly 110 with the front wing 108 removed. As shown in FIG. 11A, each first passageway 132 may receive a corresponding projection 150 in the axial direction. The lumen of the keyed connector 116 may receive the connector body 148. Upon rotation of the front wing 108 and corresponding keyed connector 116 relative to the mast assembly 110, each projection 150 may travel along the corresponding second passageway 134. The front wing 108 may be rotated relative to the mast assembly 110 until each cutout 152 in the projection(s) 150 interfaces with the corresponding protrusion 135 in the second passageway(s) 134. For example, FIG. 11C illustrates a cutout 152 interfacing or interlocking with a protrusion 135 at a first locking location 170. FIG. 11D illustrates another cutout 152 interfacing or interlocking with another protrusion 135 at a second locking location 172. The second locking location 172 may be axially and/or circumferentially offset from the first locking location 170. When assembled, the mast assembly 110 may be axially locked relative to the keyed connector 116 at one or more locations 170, 172.

Figure 11E:
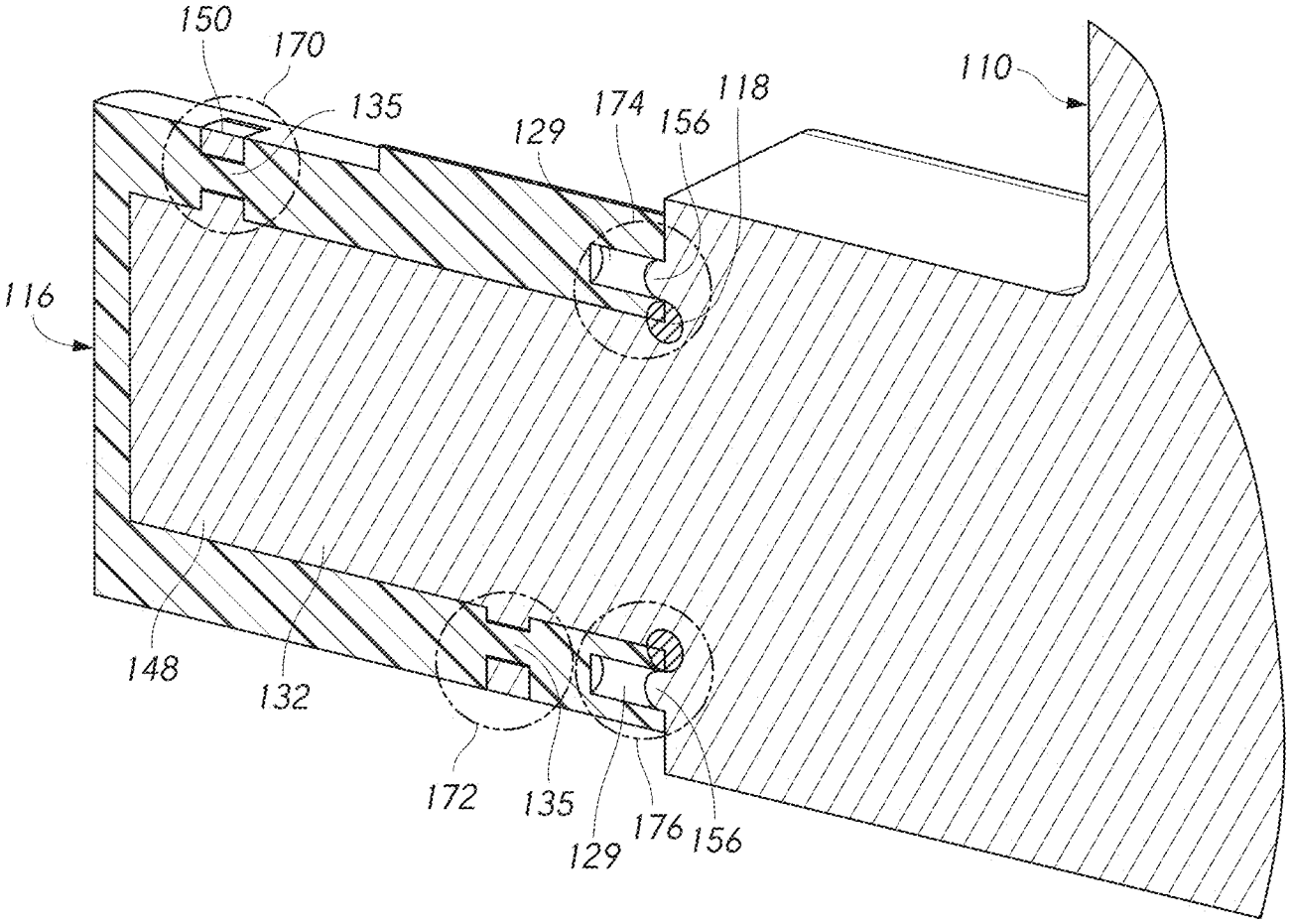

FIG. 11E illustrates a cross-section of the assembly between the keyed connector 116 and the mast assembly 110. Grooves 128 on an end face of the keyed connector 116 may receive a corresponding protrusion 156 on the front connection portion 140. As the front wing 108 is rotated relative to the mast assembly 110, each protrusion 156 travels along the corresponding groove 128 until each protrusion 156 interfaces with a corresponding socket 129. The ball-shaped projection(s) 156 and corresponding socket(s) 129 prevent radial movement at one or more locations 174, 176. When assembled, the mast assembly 110 may be rotationally locked relative to the keyed connector 116.

Figure 12:
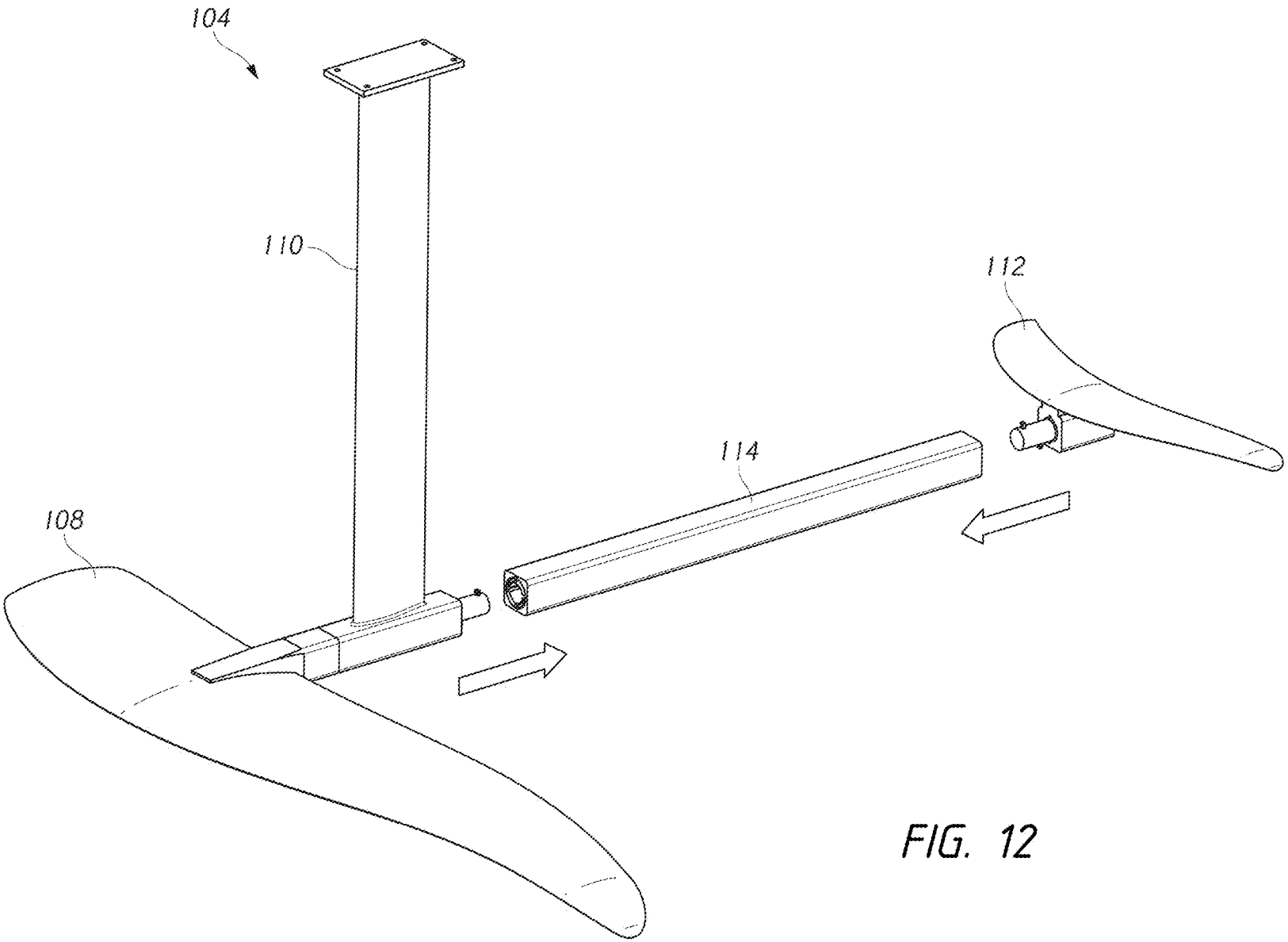
FIG. 12 illustrates a partial exploded view of the hydrofoil shown in FIG. 3A.

FIG. 12 illustrates the mast assembly 110 joined to the front wing 108 prior to the assembly of the shaft housing 114 and the rear wing 112. The toolless connections between the shaft housing 114 and the mast assembly 110 or the rear wing 112 and the shaft housing 114 may include any of the features of the toolless connection between the mast assembly 110 and the front wing 108. Further, as described above, any of the toolless connections may be reversed from the illustrated embodiment.

Figure 13A:
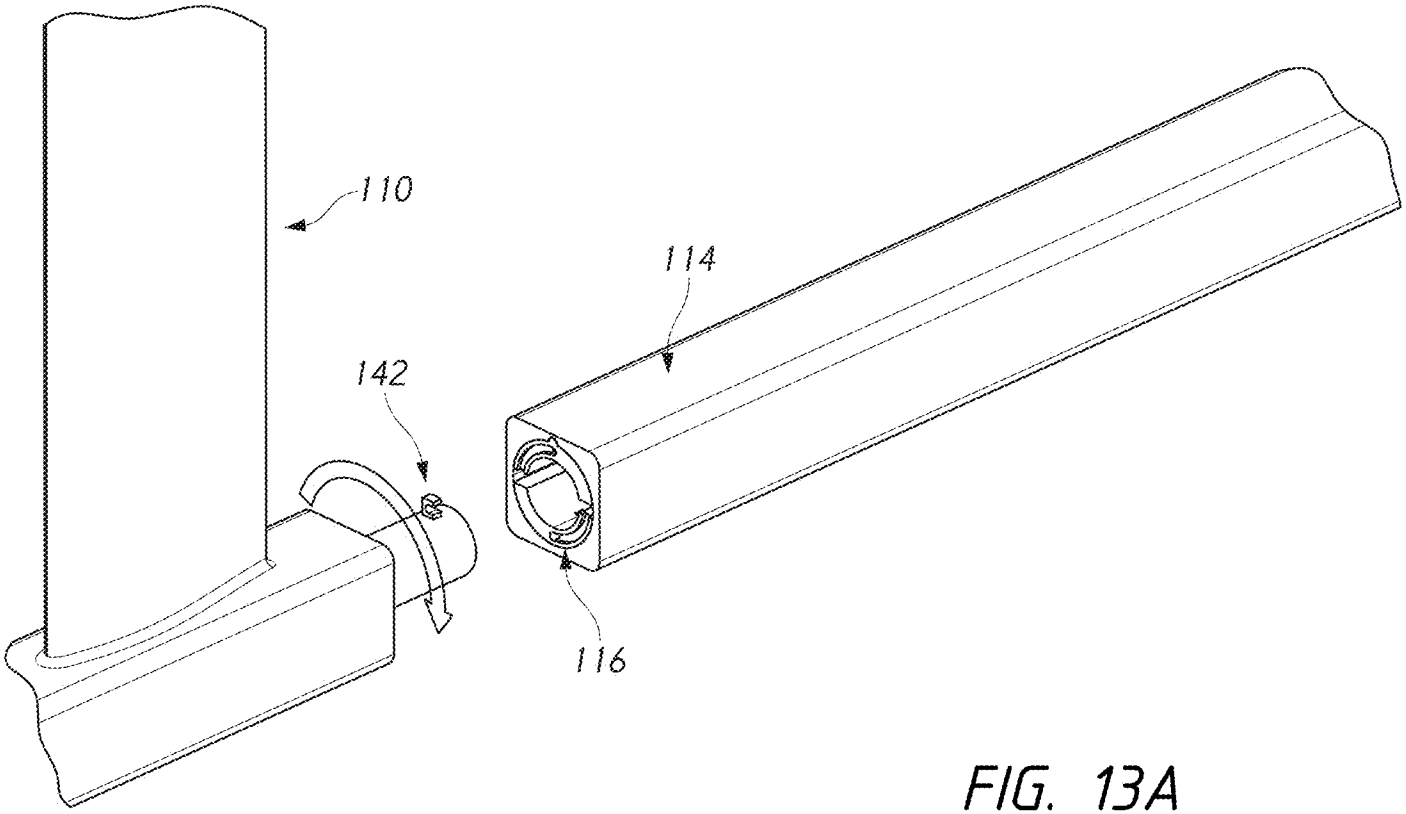
FIGS. 13A-13B illustrate exemplary details of assembling a sub-assembly of the hydrofoil including the mast assembly shown in FIGS. 6A-6B and the shaft housing shown in FIG. 7.
Figure 13B:
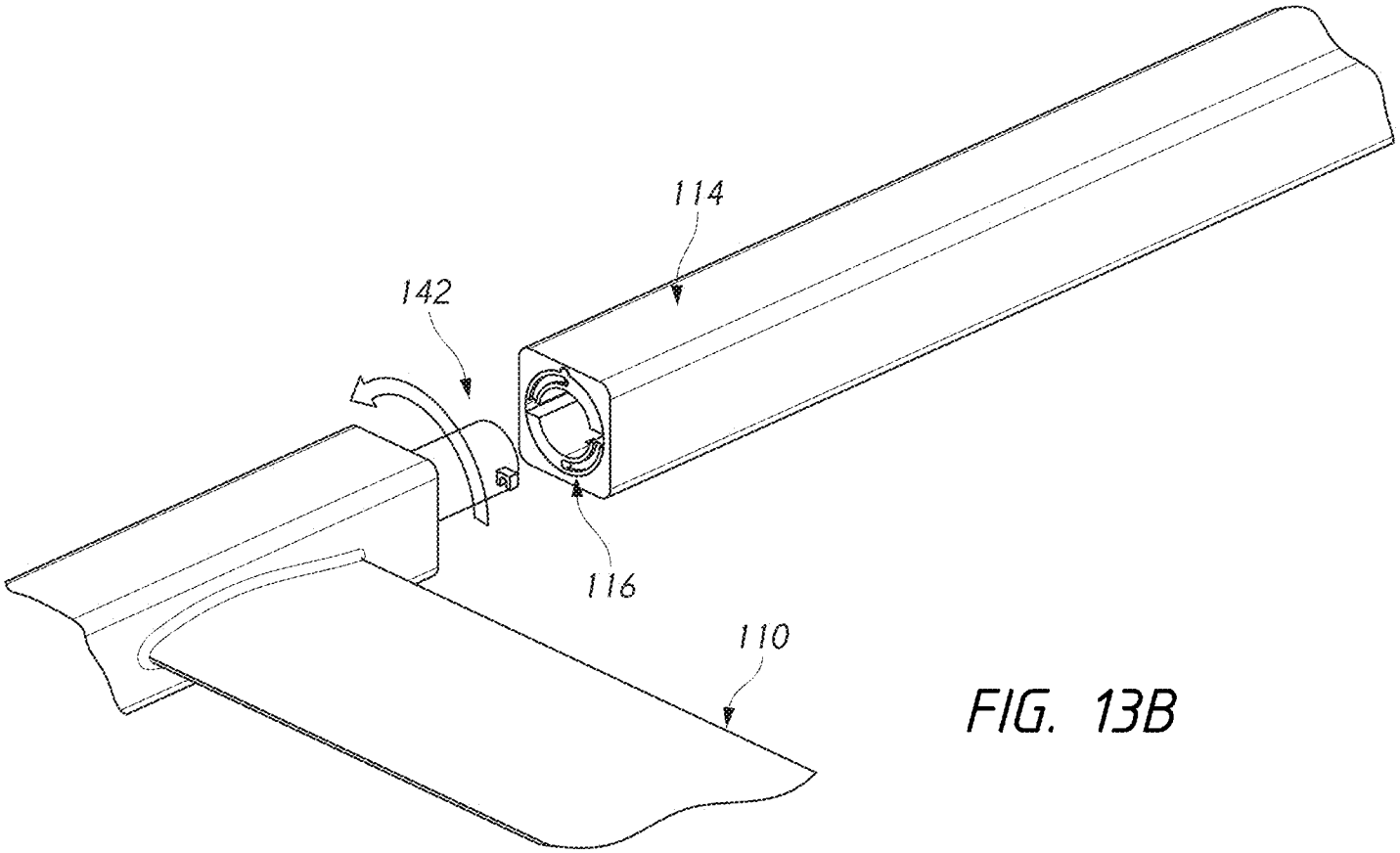
Figure 14A:
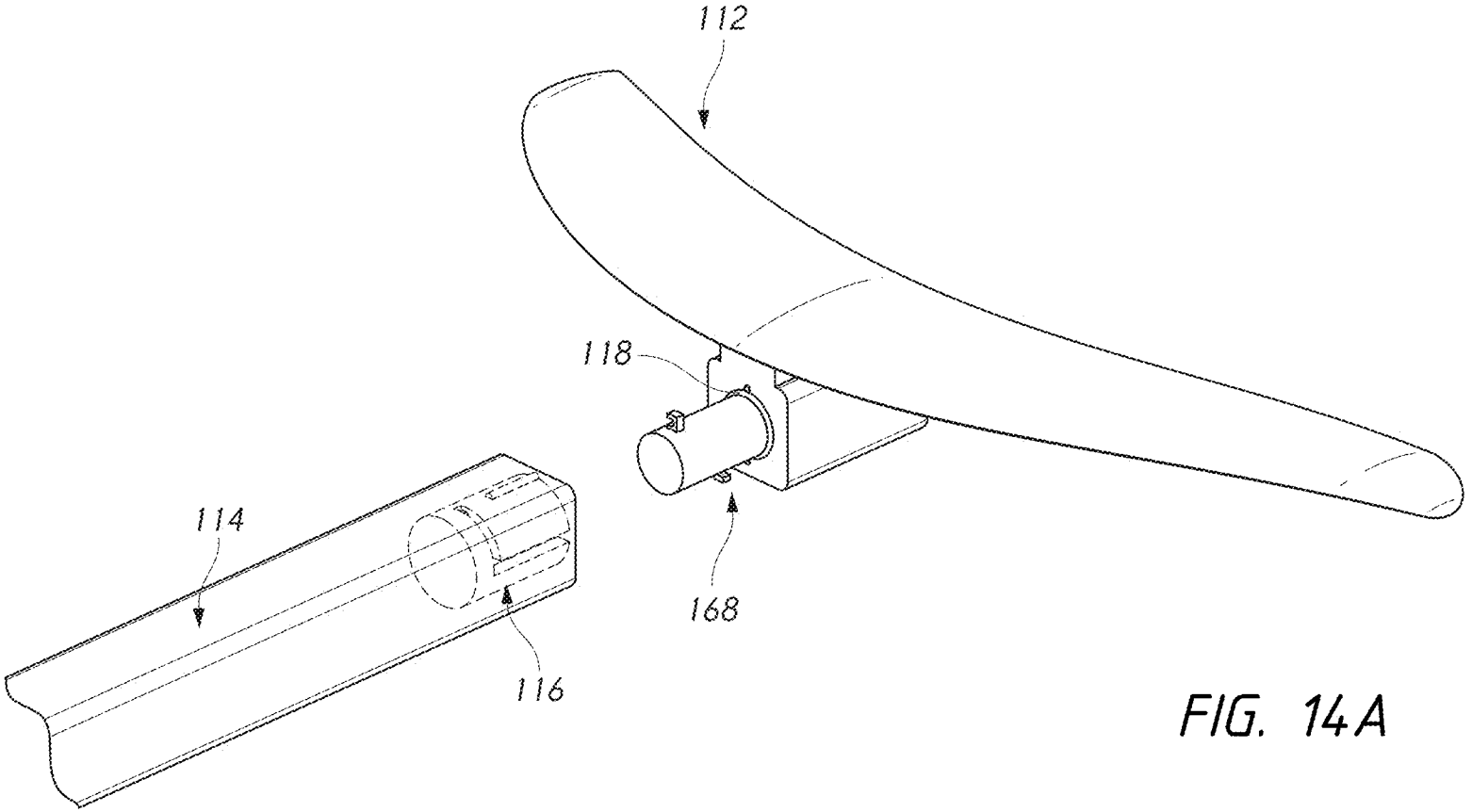
FIGS. 14A-14E illustrate exemplary details of assembling a sub-assembly of the hydrofoil including the shaft housing shown in FIG. 7 and the rear wing shown in FIG. 8.
Figure 14B:
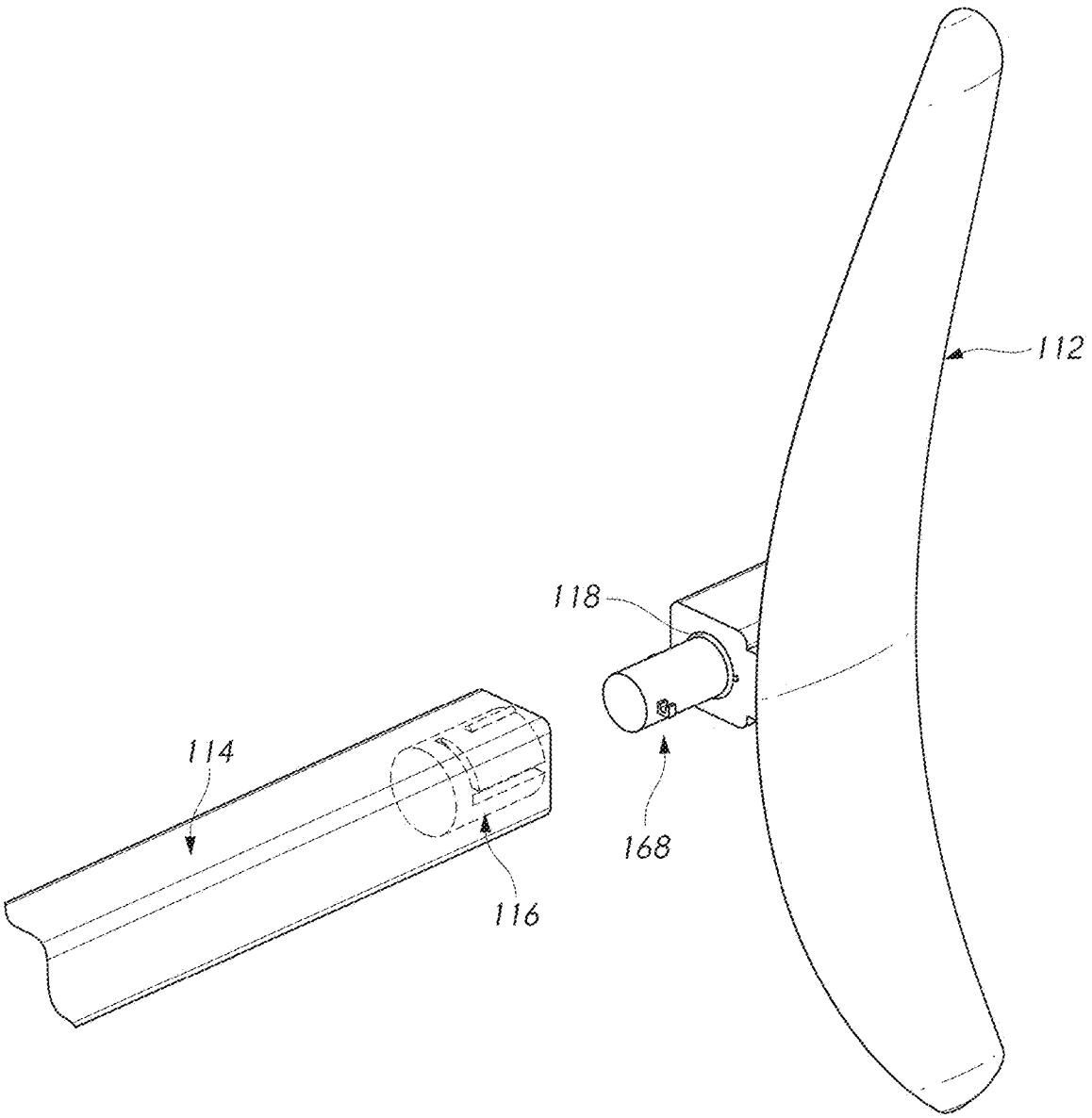
Figure 14C:
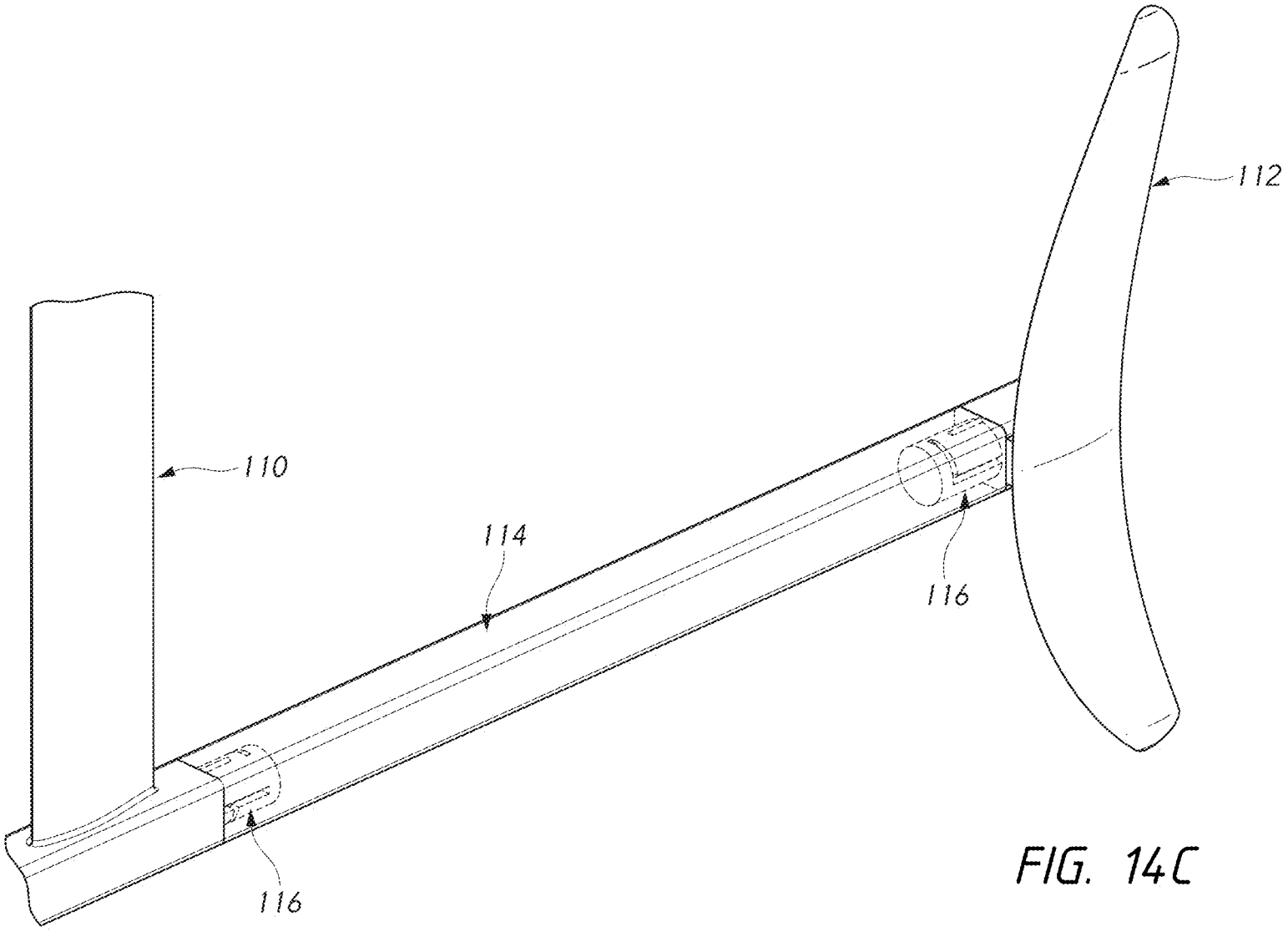
Figure 14D:
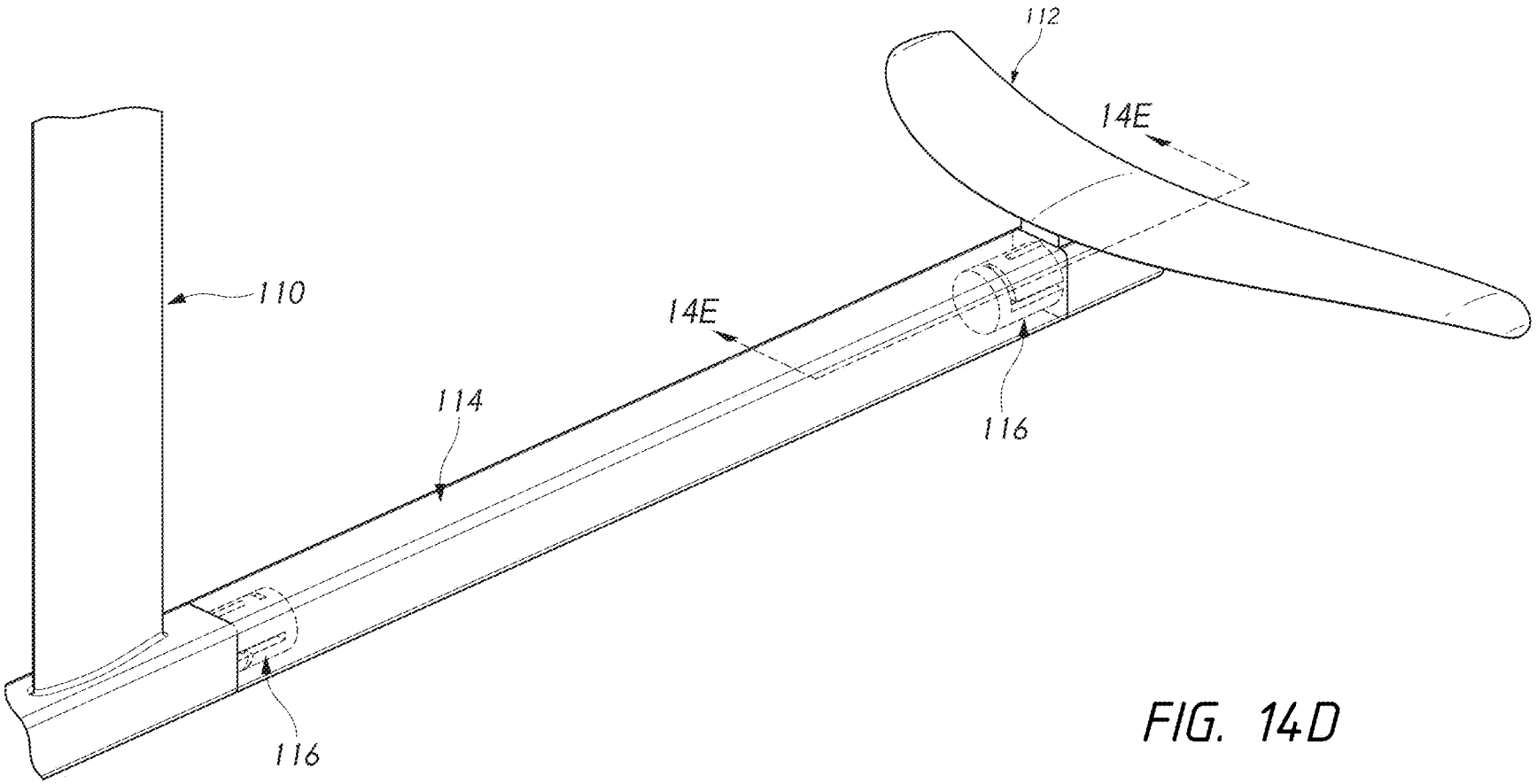
Figure 14E:
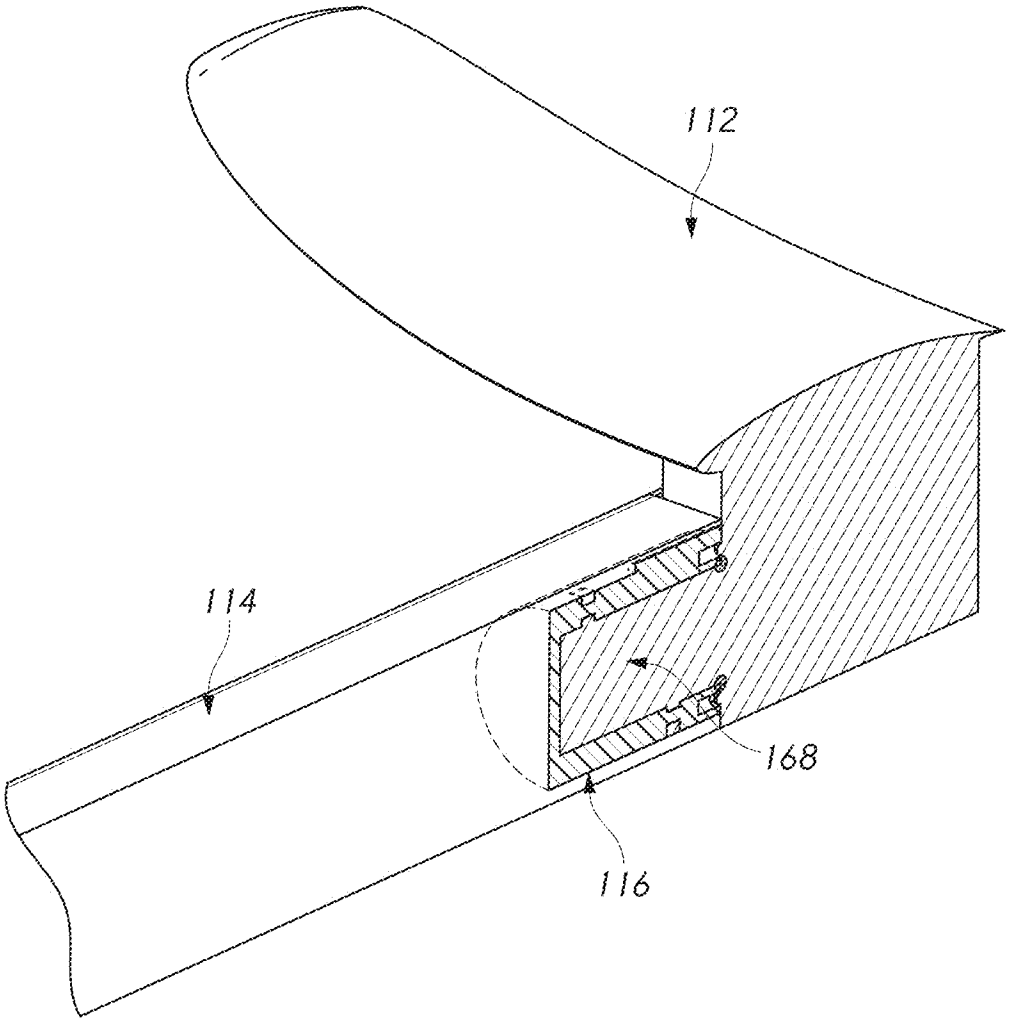

FIGS. 13A and 13B illustrate the assembly of the mast assembly 110 and the shaft housing 114. A front portion of the shaft housing 114 may at least partially receive the keyed connector 116. For example, the entire keyed connector 116 may be disposed within the front portion of the shaft housing 114. The keyed connector 116 may engage the rear connection portion 142 similar to the connection between the front wing 108 and the front connection portion 140. For assembly, the mast assembly 110 may be rotated relative to the shaft housing 114 from its ordinary position in use, for example by less than or equal to 360 degrees (or less than or equal to 270 degrees, or less than or equal to 180 degrees, or less than or equal to 90 degrees, or less than or equal to 45 degrees, or otherwise), axially and/or rotationally lock the shaft housing 114 and the mast assembly 110.

FIGS. 14A to 14E illustrate the assembly of the shaft housing 114 and the rear wing 112. A rear portion of the shaft housing 114 may at least partially receive another keyed connector 116. For example, the entire keyed connector 116 may be disposed within the rear portion of the shaft housing 114. The keyed connector 116 may engage the rear wing 112 similar to the connection between the front wing 108 and the front connection portion 140 of the mast assembly 110. For assembly, the rear wing 112 may be rotated relative to the shaft housing 114 from its ordinary position in use, for example by less than or equal to 360 degrees (or less than or equal to 270 degrees, or less than or equal to 180 degrees, or less than or equal to 90 degrees, or less than or equal to 45 degrees, or otherwise), for the keyed connector 116 disposed in the shaft housing 114 to axially and/or rotationally lock the shaft housing 114 and rear wing 112.

A kit may be provided where the kit includes any combination of the components described herein. Moreover, the kit may include different shapes or sizes of any of the components described herein, for example the front wing, rear wing, mast, and/or baseplate. For example, the kit may include different sized and/or shaped components for surfboards and kiteboards.

Terminology

As used herein, the terms "front" and "rear" are defined from the perspective of the surfboard in use.

Note that the terms "first" and "second" can be used interchangeably (e.g., first connection feature and second connection feature) and does not require the presence of the "first" and "second" features to be present.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Although certain embodiments and examples have been described herein, it will be understood by those skilled in the art that many aspects of the systems shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

What is claimed is:

1. A hydrofoil configured to be attached to a board configured for water sports, the hydrofoil configured to interact with water as the board moves to create lift, the hydrofoil comprising:

a front wing;

a rear wing;

a mast assembly configured to be secured to the front wing; and a shaft housing extending between the mast assembly and the rear wing, wherein the front wing, the rear wing, the mast assembly, and the shaft housing are secured together by toolless connections, each of the toolless connections comprising a keyed connector configured to mate with a corresponding connection portion, and wherein each of the toolless connections is configured to be assembled by rotating the keyed connector relative to the corresponding connection portion by less than or equal to 180 degrees.

2. The hydrofoil of claim 1, wherein when assembled, the toolless connections are not visible from an exterior of the hydrofoil.

3. The hydrofoil of claim 1, wherein the toolless connections are configured to prevent radial movement between the mast assembly and the front wing and/or the rear wing.

4. The hydrofoil of claim 1, wherein the toolless connections are configured to prevent axial movement between the mast assembly and the front wing and/or the rear wing.

5. The hydrofoil of claim 1, wherein the keyed connector comprises an alignment feature configured to mate with the front wing, the rear wing, the mast assembly, or the shaft housing.

6. The hydrofoil of claim 1, wherein the keyed connector comprises a passageway configured to receive a projection on the corresponding connection portion.

7. The hydrofoil of claim 1, wherein the keyed connector comprises an arcuate groove configured to receive a ball-shaped protrusion on the corresponding connection portion.

8. The hydrofoil of claim 1, wherein each of the toolless connections is configured to be assembled by rotating the keyed connector relative to the corresponding connection portion by less than or equal to 90 degrees.

9. The hydrofoil of claim 1, wherein each of the toolless connections comprise a seal.

10. A toolless connection for attaching components of a hydrofoil, the toolless connection comprising:

a connection portion on a first component of the hydrofoil, the connection portion comprising a connector body; and a keyed connector on a second component of the hydrofoil, the keyed connector configured to mate with the connection portion, the keyed connector comprising:

a body defining a lumen;

a first connection feature configured to interface with a corresponding first connection feature on the connection portion to prevent axial movement between the keyed connector and the connection portion; and a second connection feature configured to interface with a corresponding second connection feature on the connection portion to prevent radial movement between the keyed connector and the connection portion;

wherein the toolless connection is configured to be assembled by rotating the keyed connector relative to the connection portion by less than or equal to 180 degrees.

11. The toolless connection of claim 10, wherein:

the first connection feature comprises a first passageway extending in an axial direction from an end face of the body and along at least a partial length of the body, the first connection feature further comprising a second passageway extending in a radial direction from the first passageway and along at least a partial circumference of the body; and the corresponding first connection feature comprises a projection extending from the connector body.

12. The toolless connection of claim 11, wherein:

the keyed connector comprises a plurality of the first connection feature circumferentially spaced apart on the body; and the connector body comprises a plurality of the corresponding first connection feature.

13. The toolless connection of claim 10, wherein:

the second connection feature comprises an arcuate groove on an end face of the body; and the corresponding second connection feature comprises a protrusion displaced from an end face of the connector body.

14. The toolless connection of claim 13, wherein:

the keyed connector comprises a plurality of the second connection feature circumferentially spaced apart on the end face of the body; and the connection portion comprises a plurality of the corresponding second connection feature.

15. The toolless connection of claim 10, further comprising a seal.

16. A method of assembly a hydrofoil, the method comprising:

rotating a mast assembly relative to a front wing to prevent axial and radial movement between the mast assembly and the front wing;

rotating a shaft housing relative to the mast assembly to prevent axial and radial movement between the shaft housing and the mast assembly; and rotating a rear wing relative to the shaft housing to prevent axial and radial movement between the rear wing and the shaft housing.

17. The method of claim 16, wherein:

rotating the mast assembly relative to the front wing by less than 180 degrees prevents axial and radial movement between the mast assembly and the front wing;

rotating the shaft housing relative to the mast assembly by less than 180 degrees prevents axial and radial movement between the shaft housing and the mast assembly; and rotating the rear wing relative to shaft housing by less than 180 degrees prevents axial and radial movement between the rear wing and the shaft housing.

18. The method of claim 16, further comprising:

inserting a front connection portion on the mast assembly into a keyed connector in the front wing;

inserting a rear connection portion on the mast assembly into a front keyed connector in the shaft housing; and inserting a connection portion on the rear wing into a rear keyed connector in the shaft housing.

* * * * *